US008543020B2

(12) United States Patent
Miyadera et al.

(10) Patent No.: US 8,543,020 B2
(45) Date of Patent: Sep. 24, 2013

(54) IMAGE FORMING APPARATUS AND METHOD OF CORRECTING IMAGE MISALIGNMENT

(75) Inventors: Tatsuya Miyadera, Ikeda (JP); Tomohiro Ohshima, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 604 days.

(21) Appl. No.: 12/723,813

(22) Filed: Mar. 15, 2010

(65) Prior Publication Data

US 2010/0232817 A1 Sep. 16, 2010

(30) Foreign Application Priority Data

Mar. 13, 2009 (JP) ..... 2009-061698

(51) Int. Cl.
*G03G 15/00* (2006.01)

(52) U.S. Cl.
USPC ..... 399/46; 399/49; 399/66; 399/301

(58) Field of Classification Search
USPC ..... 399/46, 49, 66, 299–302, 308
See application file for complete search history.

(56) References Cited

U.S. PATENT DOCUMENTS

| | | | | |
|---|---|---|---|---|
| 2007/0134014 | A1* | 6/2007 | Kato et al. | 399/49 |
| 2007/0172257 | A1* | 7/2007 | Matsuda et al. | 399/167 |
| 2008/0231649 | A1* | 9/2008 | Kawabata et al. | 347/14 |
| 2009/0047032 | A1* | 2/2009 | Hosier et al. | 399/49 |
| 2009/0074476 | A1 | 3/2009 | Miyadera | |
| 2009/0196636 | A1 | 8/2009 | Miyadera | |

FOREIGN PATENT DOCUMENTS

| | | |
|---|---|---|
| JP | 2642351 | 5/1997 |
| JP | 2858735 | 12/1998 |
| JP | 2004-21164 | 1/2004 |
| JP | 2007-240591 | 9/2007 |

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

An image forming apparatus includes a transport member, image forming units (used as pattern forming unit), a pattern detector, and an image misalignment detector. The image forming units form correction-use patterns for each color on the transport member. The pattern detector directs a light beam onto the transport member having the correction-use patterns and detect reflected light reflecting from the transport member. The image misalignment detector detects image misalignment of the correction-use patterns. The pattern forming unit forms a reference color pattern and a first color pattern. The pattern detector uses an irradiation light having a first wavelength matched to a spectral sensitivity peak of the first color pattern to detect an intensity of reflected light reflected from the transport member. The image misalignment detector computes an image misalignment value between the reference and first color patterns based on the intensity of reflected light reflected from the transport member.

13 Claims, 16 Drawing Sheets

IMAGE FORMING APPARATUS AND METHOD OF CORRECTING IMAGE MISALIGNMENT

CROSS-REFERENCE TO RELATED APPLICATIONS

This application claims priority to Japanese Patent Application No. 2009-061698, filed on Mar. 13, 2009 in the Japan Patent Office, which is hereby incorporated by reference herein in its entirety.

BACKGROUND OF THE INVENTION

1. Field of the Invention

The present invention relates to an image forming apparatus for forming a visible image by superimposing a plurality of color images on top of one another, the image forming apparatus having a function of correcting misalignment of image positions of the plurality of color images, and a method of correcting image misalignment.

2. Description of the Background Art

Typically, image forming apparatuses employing electrophotography form a full-color visible image by superimposing a plurality of color images on top of each other. For example, image forming apparatuses may use four single colors for image forming, in which a single image is formed with each of the four colors, and then four single-color images are superimposed to form a full-color image. Such image forming apparatuses may be known as tandem-type image forming apparatuses, for example.

The tandem-type image forming apparatus typically employs either an indirect transfer system or a direct transfer system. In the indirect transfer system, an image formed on an image bearing member is initially transferred onto an intermediate transfer belt, whereas in the direct transfer system, an image formed on an image bearing member is directly transferred onto a transfer sheet transported on a sheet transport belt.

In such apparatuses, a color pattern is used to detect and correct misalignment between images. Accordingly, a color pattern used for correcting image misalignment between images may be formed for each color on the intermediate transfer belt in the indirect transfer system but on the sheet transport belt in the direct transfer system. Such correction-use patterns may be detected by an optical sensor, such as a toner marking (TM) sensor, to correct an image write-timing so that four single-color images can be superimposed correctly to form a single full-color image. Such tandem-type image forming apparatus is disclosed in JP-2858735-B and JP-2642351-B, for example.

With the use of such optical sensors, the spectral sensitivity of the optical sensors becomes an important consideration. For example, JP-2007-240591-A discloses a light scanning unit including a light source such as a laser diode (LD), an optical system, and at least one detector such as a photodiode, which can maintain a stable output signal even when certain properties of the laser diodes vary among different manufacturing lots or when the use environment of the light scanning unit changes. The optical system deflects a light beam emitted from the light source to scan an image bearing member and the detector detects the light beam at a given position. In such light scanning unit, the laser diode used as the light source has an oscillation wavelength shorter than 450 nm, and the optical system includes an optical member having a spectral sensitivity that is the opposite of the spectral sensitivity of the photodiode used as the detector.

Further, JP-2004-21164-A discloses a color image forming apparatus including an image concentration sensor to detect concentration of images. The image concentration sensor includes a light source, which emits visible light toward a target image, and a light-receiving sensor, which detects light reflected from the target image. In such image forming apparatus, a light source suitable for the detection process employed is provided for each color. Accordingly, the number of image concentration sensors must match the number of colors, thus increasing the overall cost of the color image forming apparatus.

In light of the above-described situation, there has been proposed an image forming apparatus including an image concentration sensor to detect concentration of images, in which a light source emits visible light toward a target image and light reflected from the target image is detected to determine the image concentration. In such image forming apparatus, there are fewer light sources than colors to be detected, and a single light-receiving sensor is used in common for all colors to provide good detection precision at reduced cost.

A TM sensor to detect the correction-use pattern may include a light-emitting diode (LED) as a light emitting device and a photodiode (PD). The LED directs a beam of light onto either a sheet transport belt or an intermediate transfer belt and the PD receives light reflected from the belt. Such reflected light includes a regular reflected light component and a diffuse reflected light component. The TM sensor uses the regular reflected light component to detect the correction-use pattern because the regular reflected light is reflected from a surface of the belt strongly but not reflected from a toner image, whereas the diffuse reflected light is reflected from a toner image of the color pattern (not including black) weakly but not reflected from a surface of sheet transport belt and a black toner image.

As such, in a process of correcting image misalignment, the diffuse reflected light component signal may not be needed. Accordingly, the TM sensor may employ a configuration to remove the diffuse reflected light component before the reflected light enters a light receiving unit such as a PD. In this case, a slit or a focus lens may be used to remove the diffuse reflected light component and the PD is used as a light receiving unit to receive a regular reflected light component. However, such configuration may increase the cost of the TM sensor. By contrast, in a lower-cost TM sensor, which does not need such configuration, a light receiving unit such as the PD receives the regular reflected light and the diffuse reflected light mixed together when detecting a correction-use pattern.

However, if the LED and the PD are out of alignment due to mechanical tolerance or assembly error, a color pattern detection signal may include both the regular reflected light component and the diffuse reflected light component, in which a peak position of the regular reflected light component and a peak position of diffuse reflected light component do not match. Such unmatched peak position condition may result in image misalignment detection error.

SUMMARY

In one aspect of the present invention, an image forming apparatus is devised. The image forming apparatus includes an endless transport member, a plurality of image forming units, a pattern detector, and an image misalignment detector. The plurality of image forming units include a plurality of image bearing members arranged along a moving direction of the endless transport member. Each of the image bearing members forms images of one of multiple colors using electrophotography. The images are transferable to the endless transport member. Each of the image forming units is useable as a pattern forming unit to form a plurality of correction-use patterns for each color on the endless transport member. The pattern detector, disposed near the endless transport member, detects the correction-use patterns formed on the endless transport member by directing a light beam onto the correction-use patterns formed on the endless transport member. The pattern detector is capable of detecting regular reflected light and diffuse reflected light reflecting from the endless transport member and the correction-use patterns formed on the endless transport member. The image misalignment detector detects image misalignment of the correction-use patterns formed on the endless transport member based on a detection result of the correction-use patterns obtained by the pattern detector. The pattern forming unit forms at least a reference color pattern and a first color pattern as correction-use patterns, in which each of the reference color pattern and the first color pattern is formed as a developed image. The pattern detector uses an irradiation light having a first wavelength matched to a spectral sensitivity peak of the first color pattern to detect an intensity of light reflected from the endless transport member having the reference color pattern and the first color pattern formed thereon. The image misalignment detector computes an image misalignment value between two color images of the reference color pattern and the first color pattern, based on the intensity of reflected light reflected from the reference color pattern and the first color pattern as detected by the pattern detector.

In another aspect of the present invention, a method of correcting image misalignment of images formed by an image forming apparatus is devised. The image forming apparatus includes an endless transport member, a plurality of image forming units, a pattern detector, and an image misalignment detector. The plurality of image forming units include a plurality of image bearing members arranged along a moving direction of the endless transport member. Each of the image bearing members forms images of one of multiple colors using electrophotography. The images are transferable to the endless transport member. Each of the image forming units is useable as a pattern forming unit to form a plurality of correction-use patterns for each color on the endless transport member. The pattern detector, disposed near the endless transport member, detects the correction-use patterns formed on the endless transport member by directing a light beam onto the correction-use patterns formed on the endless transport member. The pattern detector is capable of detecting regular reflected light and diffuse reflected light reflecting from the endless transport member and the correction-use patterns formed on the endless transport member. The image misalignment detector detects image misalignment of the correction-use patterns formed on the endless transport member based on a detection result of the correction-use patterns obtained by the pattern detector. The method comprising the steps of forming, detecting, and computing. The forming step forms at least a reference color pattern and a first color pattern using the pattern forming unit as correction-use patterns, in which each of the reference color pattern and the first color pattern is formed as a developed image. The detecting step detects, using the pattern detector, an intensity of light reflected from the endless transport member and the correction-use patterns formed on the endless transport member by irradiating the reference color pattern and the first color pattern with an irradiation light having a first wavelength matched to a spectral sensitivity peak of the first color pattern. The computing step computes, using the image misalignment detector, an image misalignment value between two color images of the reference color pattern and the first color pattern, based on the intensity of reflected light reflected from the reference color pattern and the first color pattern as detected by the pattern detector.

In still another aspect of the present invention, a computer-readable medium storing a program for correcting image misalignment of images formed by an image forming apparatus is devised. The program includes instructions that when executed by a computer cause the computer to execute a method of correcting image misalignment of images formed by an image forming apparatus. The image forming apparatus includes an endless transport member, a plurality of image forming units, a pattern detector, and an image misalignment detector. The plurality of image forming units include a plurality of image bearing members arranged along a moving direction of the endless transport member. Each of the image bearing members forms images of one of multiple colors using electrophotography. The images are transferable to the endless transport member. Each of the image forming units is useable as a pattern forming unit to form a plurality of correction-use patterns for each color on the endless transport member. The pattern detector, disposed near the endless transport member, detects the correction-use patterns formed on the endless transport member by directing a light beam onto the correction-use patterns formed on the endless transport member. The pattern detector is capable of detecting regular reflected light and diffuse reflected light reflecting from the endless transport member and the correction-use patterns formed on the endless transport member. The image misalignment detector detects image misalignment of the correction-use patterns formed on the endless transport member based on a detection result of the correction-use patterns obtained by the pattern detector. The method comprising the steps of forming, detecting, and computing. The forming step forms at least a reference color pattern and a first color pattern using the pattern forming unit as correction-use patterns, in which each of the reference color pattern and the first color pattern is formed as a developed image. The detecting step detects, using the pattern detector, an intensity of light reflected from the endless transport member and the correction-use patterns formed on the endless transport member by irradiating the reference color pattern and the first color pattern with an irradiation light having a first wavelength matched to a spectral sensitivity peak of the first color pattern. The computing step computes, using the image misalignment detector, an image misalignment value between two color images of the reference color pattern and the first color pattern, based on the intensity of reflected light reflected from the reference color pattern and the first color pattern as detected by the pattern detector.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 10(*a*) illustrates an example relation of correction-use pattern, spot diameter of irradiation light, and spot diameter of regular reflected light receiving unit, FIG. 10(*b*) illustrates an example relation of diffusion light component and regular reflected light component included in a received light signal reflected from a correction-use pattern, FIG. 10(*c*) illustrates an output signal of regular reflected light receiving unit and a method of computing a center position of correction-use pattern;

Figure 1:
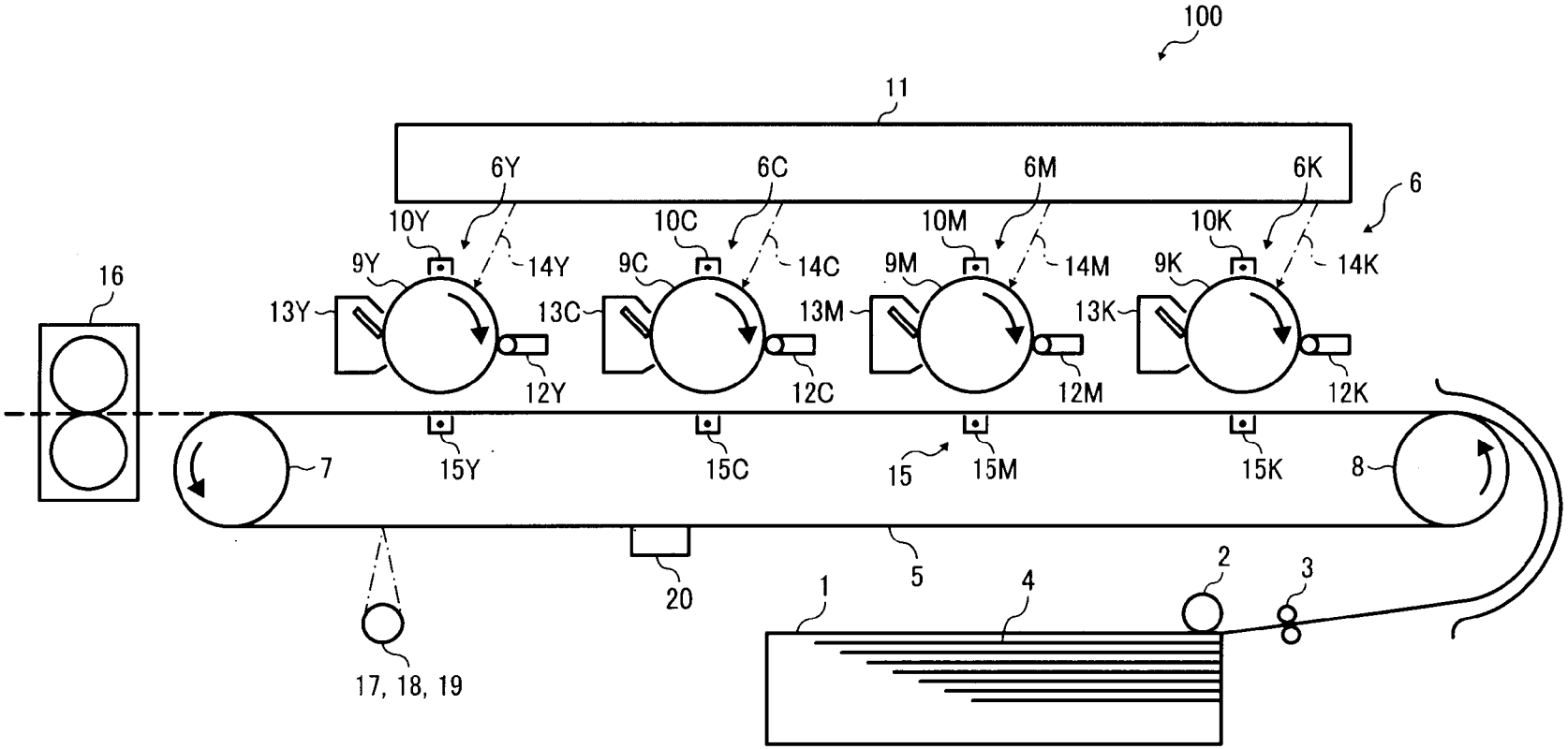
FIG. 1 illustrates a schematic configuration of an image forming apparatus according to first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, Operations, elements, and/or components, but do not preclude the presence or addition of one or more other features, integers, steps, Operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming system and an image forming apparatus according to example embodiments are described.

To detect color patterns reliably using a lower cost sensor (e.g., toner marking (TM) sensor) to prevent cost increase, a detector which can reduce an effect of diffusion light reflected from a color pattern may be required. Such detection can be conducted by using a TM sensor irradiating a light beam having a complementary color relation with a color pattern. Such TM sensor may use a light emitting diode (LED) as a light source. When a light beam having a complementary color relation with a color pattern is irradiated to the color pattern, the light beam is absorbed by the color pattern, by which diffuse reflected light may not be reflected from the color pattern as similar to black color. With such a configuration, detection error may not be included in a detection result obtained for black pattern and color pattern, by which correction of image misalignment can be conducted correctly.

When a light beam not having a complementary color relation with a color pattern is irradiated to the color pattern, reflected light from the color pattern may include a diffuse reflected light component, by which a detection result may include detection error. For example, when a blue-LED is used as a light source to irradiate a light beam, detection of correction-use pattern can be correctly conducted for a yellow pattern, but not for other patterns such as magenta and cyan patterns. If correction of image misalignment can be correctly conducted for two colors such as black and yellow, image misalignment between colors using opposed reflection faces of a polygon mirror for exposing process during a low speed printing can be correctly corrected.

A rotatable multi-faced mirror (or polygon mirror) driven by a polygon motor may be used for an exposing process. During the exposing process, an image write-timing may be adjusted using a synchronization detector (e.g., photodiode PD), wherein the synchronization detector may be disposed at a given position that can detect a light beam used for image forming.

When a low speed printing is conducted, the rotation number of polygon mirror becomes smaller, and thereby a light-enter speed of light beam to the synchronization detector also becomes slower. Typically, a synchronization detector such as PD may have given time delay for detecting a light beam, which may be referred to as "detection delay value." Such detection delay value may be a constant value whether a polygon mirror is rotated at a normal speed, high speed, or low speed.

A correction of image misalignment may be conducted when a polygon mirror is rotated at a normal speed using the synchronization detector PD having a given detection delay value. When the rotation speed of the polygon mirror is changed from the normal speed to a low speed, and then a correction of image misalignment is conducted at the low speed, a writing position for exposing process may change because the detection delay value is not changed even when the rotation speed of the polygon mirror is changed, by which an image misalignment may occur. Such image misalignment may not be observed between two colors using a same face of polygon mirror for the exposing process because such two colors may have a same image misalignment value. As such, a relative image misalignment value of such two colors may be zero "0." However, as for two colors using opposed faces of polygon mirror, image misalignment direction becomes opposite directions between the two colors, by which a relative image misalignment value of such two colors may become a two-times value of detection delay value.

As such, image misalignment may occur for two color images using opposed faces of polygon mirror for an exposing process during a low speed printing. In such a case, image misalignment value for two color images using opposed faces of polygon mirror with each other may be computed, and then image misalignment for two color images may be corrected, and then such image misalignment correction can be applied to other color images. If black and yellow images have such opposed-face relation, a blue-LED can be used as an irradiation light to correctly detect image misalignment, which may occur during an exposing process using the opposed faces polygon mirror, and then image misalignment can be corrected.

In example embodiments, during an exposing process, a black image is formed using one face of polygon mirror, and a color image is formed using another face of polygon mirror, which is an opposed face with respect to the face used for black image. The color image may be detected by irradiating a light beam having a complementary color relation with the color image to reduce detection error of color pattern. With such a configuration, correction of image misalignment can be conducted correctly between the black image and the color image, which are formed using opposed faces of polygon mirror. As such, correction of image misalignment can be conducted correctly between given two colors using opposed faces of polygon mirror for forming images.

In example embodiments to be described later may use four colors of black K, magenta M, cyan C, and yellow Y images for forming a full-color image, in which black K and magenta M images may be formed using a same one face of polygon mirror, and cyan C, and yellow Y images may be formed using another same one face of polygon mirror, which are opposed faces each other.

FIG. 1 illustrates a schematic configuration of an image forming apparatus 100 according to first example embodiment. The image forming apparatus 100 may be a tandem-type image forming apparatus using a direct transfer system, in which image forming units for each color are arranged along a sheet transport belt used as an endlessly travelling member. The image forming apparatus 100 may include a sheet feed unit 1, an exposure unit 11, an image forming unit 6, a sheet transport belt 5, a transfer device 15, and a fixing unit 16, for example.

The sheet feed unit 1 may include a sheet feed roller 2 and a separation roller 3, which separates and feeds a sheet 4 (or recording sheet 4) to the sheet transport belt 5. The sheet transport belt 5 transports the sheet 4 while electrostatically adhering the sheet 4 on the sheet transport belt 5.

The image forming unit 6 may include image forming units for four colors such as black(K), magenta(M), cyan(C), and yellow(Y), which may be referred to as image forming units 6K, 6M, 6C, 6Y. The image forming unit 6 may employ electrophotography processing for image forming. The image forming units 6K, 6M, 6C, 6Y may be arranged with a given order along a rotation direction of the sheet transport belt 5 such as from an upstream side of rotation direction of the sheet transport belt 5. Such image forming units 6K, 6M, 6C, 6Y may employ a similar internal configuration except colors of toner. For example, the image forming unit 6K forms black image, the image forming unit 6M forms magenta image, the image forming unit 6C forms cyan image, and the image forming unit 6Y forms yellow image, respectively. Hereinafter, reference characters for black(K), magenta(M), cyan(C), and yellow(Y) may be omitted, as required. The image forming unit 6 and a CPU 49, to be described later, may be used as pattern forming unit.

The sheet transport belt 5, which may be an endless belt, is extended by a drive roller 7 and a driven roller 8. The drive roller 7 may be driven by a drive motor, and rotate in a direction shown by an arrow (a counter-clock direction in FIG. 1). When an image forming operation is conducted, the sheet 4 stored in the sheet feed unit 1 is sequentially fed from a top sheet in the sheet feed unit 1, and then adsorbed on the sheet transport belt 5 with an electrostatic adsorption effect. Then, the sheet 4 is transported to the image forming unit 6K with a rotation of the sheet transport belt 5, and a black toner image is transferred onto the sheet 4.

The image forming unit 6 may include a photoconductor drum 9, used as a photoconductor, a charger 10, a development unit 12, a transfer device 15, a photoconductor cleaner 13, and a de-charger, which are arranged around the photoconductor drum 9, for example. An exposing portion may be disposed between the charger 10 and the development unit 12, through which a laser beam 14 emitted from the exposure unit 11 irradiates the photoconductor drum 9. The exposure unit 11 may irradiate the laser beam 14 to form a latent image of each of colors on the photoconductor drum 9, in which the laser beam 14 is used as an exposing light beam and corresponds to an image color formed on the photoconductor drum 9 of the image forming unit 6. The transfer device 15 may be disposed at a position facing the photoconductor drum 9 by interposing the sheet transport belt 5 between the transfer device 15 and the photoconductor drum 9.

Figure 2:
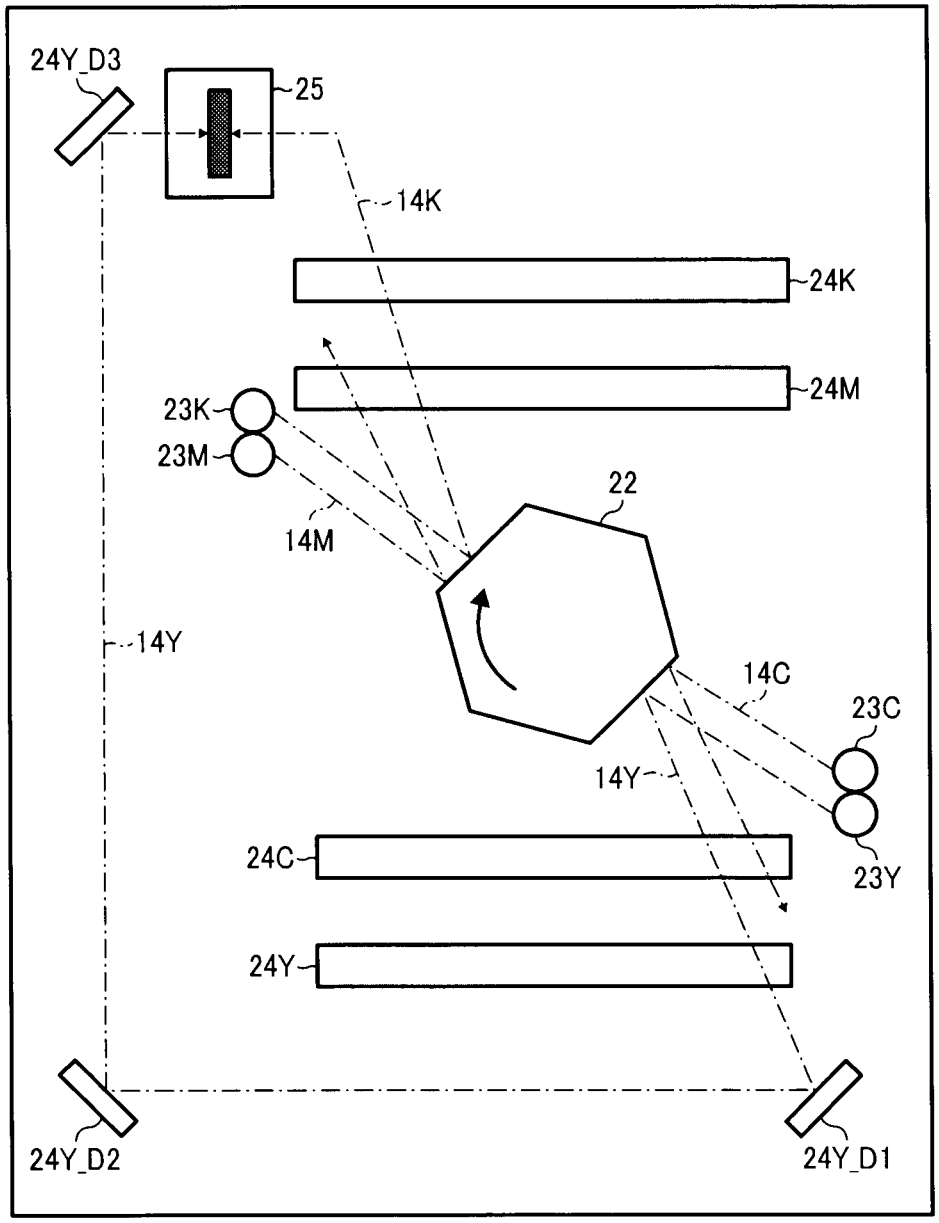
FIG. 2 illustrates a schematic configuration of an internal configuration of an exposure unit of an image forming apparatus according to first example embodiment.

FIG. 2 illustrates a schematic configuration of an internal configuration of exposure unit 11. The exposing light beams such as laser beams 14K, 14M, 14C, 14Y for each of image colors may be emitted from laser diodes 23K, 23M, 23C, 23Y used as light sources. The laser beams 14K, 14M, 14C, 14Y are deflected by a rotatable multi-faced mirror 22, and then guided to optical configurations 24K, 24M, 24C, 24Y for adjusting optical path of light beams, and such light beams scan on surfaces of the photoconductor drums 9K, 9M, 9C, 9Y. The rotatable multi-faced mirror 22 may be a polygon mirror, which may have six mirror faces (i.e., hexagonal shape), for example. The rotatable multi-faced mirror 22 may referred to polygon mirror 22. When the polygon mirror 22 rotates, one mirror face deflects an exposing light beam, which is used to scan one line image in a main scanning direction. In a configuration of FIG. 2, one polygon mirror is disposed for four light sources (i.e., laser diode 23), for example.

The laser beams 14 used as exposing light beam may be generated separately with each other. For example, a set of laser beams 14K and 14M, and a set of laser beams 14C and 14Y may be generated separately. The laser beams 14K and 14M may be deflected by one mirror face of the polygon mirror 22, and the laser beams 14C and 14Y may be deflected by an opposite mirror face of the polygon mirror 22 as illustrated in FIG. 2, by which an exposure process can be conducted for four photoconductor drums 9 at the same time. The optical member 24 may include a f-theta lens and a deflection mirror, for example. The f-theta lens sets light-reaching positions of the reflected light at the photoconductor drums 9 with a uniform interval, and the deflection mirror deflects the laser beam 14.

As illustrated in FIG. 2, a synchronization detector 25 may be disposed at a given position, which is outside of an image forming area in a main scanning direction. The synchronization detector 25 may detect the laser beams 14K and 14Y for each one-line scanning process, and based on such detection, a write-start timing of exposing process is adjusted. The synchronization detector 25 may be arranged at a position near the optical member 24K, for example, but not limited thereto. In such configuration, the laser beam 14Y may be reflected by synchronization-detection-use reflection mirrors 24Y_D1, 24Y_D2, 24Y_D3 to enter the synchronization detector 25 while the laser beam 14K may also enter the synchronization detector 25 through other path. In such configuration, the write-start timing of the laser beams 14M and 14C cannot be adjusted using the synchronization detector 25. Accordingly, a start timing of exposing process for magenta may be matched to a start timing of exposing process for black, and a start timing of exposing process for cyan is matched to a start timing of exposing process for yellow so that image positions of each of colors can be aligned.

When an image forming operation is conducted, the photoconductor drum 9K is uniformly charged by the charger 10K in a dark environment, and then exposed by the laser beam 14K for black image, emitted from the exposure unit 11, by which an electrostatic latent image for black is formed on the photoconductor drum 9K. The development unit 12K develops the electrostatic latent image by supplying and adhering black toner on the latent image, by which a black toner image can be formed on the photoconductor drum 9K.

The black toner image is then transferred onto the sheet 4 with an effect of the transfer device 15K at a transfer position where the photoconductor drum 9K contacts the sheet 4 transported on the sheet transport belt 5. With such transfer process, the black toner image can be formed on the sheet 4. After the toner image transfer, the photoconductor drum 9K is cleaned by the photoconductor cleaner 13K to remove remaining toner, and de-charged by the de-charger to prepare for a next image forming operation.

After the black toner image is transferred to the sheet 4 at the image forming unit 6K, the sheet 4 is transported to the image forming unit 6M by the sheet transport belt 5. As similar to the image forming process in the image forming unit 6K, in the image forming units 6M, 6C, 6Y, magenta, cyan, yellow toner images are formed on the photoconductor drums 9M, 9C, 9Y, and then transferred on the sheet 4 with an effect of the transfer device 15. Specifically, magenta, cyan, yellow toner images are sequentially superimposed onto the black toner image already formed on the sheet 4 by changing a transfer timing, wherein such transfer timing is corresponded to a position interval of the transfer devices 15. With such processes, a full-color image can be formed on the sheet 4. Then, the sheet 4 is separated from the sheet transport belt 5, and transported to the fixing unit 16. The full-color image is fixed by the fixing unit 16, and then ejected outside of the image forming apparatus 100.

In the image forming apparatus 100, image misalignment of toner images may occur when a plurality of toner images are superimposed one to another. Such image misalignment may occur due to a distance error between axis shafts of photoconductor drums 9K, 9M, 9C, 9Y, parallel level error between the photoconductor drums 9K, 9M, 9C, 9Y, assembly error of deflection mirror (e.g., polygon mirror) in the exposure unit 11, a write-timing error of latent image on the photoconductor drums 9K, 9M, 9C, 9Y, for example. If such condition occurs, toner images may not be correctly formed at intended position, and thereby not be superimposed correctly one to another. Such image misalignment may typically appear as skew, registration deviation in sub-scanning direction, magnification error in main scanning direction, and registration deviation in main scanning direction, for example.

Such image misalignment of toner images may need to be corrected to form a correct image. Such correction of image misalignment may be conducted using an image position of black K as a "reference (e.g., reference color, reference image, reference position, reference pattern)" and adjusting image positions of magenta M, cyan C, and yellow Y with respect to the image position of K, which may be as "first color image, first color position, first pattern, or first color pattern."

As illustrated in FIG. 1, first, second, and third toner mark sensors 17, 18, 19 may be disposed at a downstream side of the image forming unit 6Y while facing the sheet transport belt 5. The first, second, and third toner mark sensors 17, 18, 19 may detect toner patterns formed on the sheet transport belt 5. Hereinafter, the first, second, and third sensors 17, 18, and 19 may be referred to as toner marking (TM) sensors 17, 18, and 19. The TM sensors 17, 18, 19 may employ a reflection-type optical sensor, for example. The TM sensors 17, 18, 19 may be supported on one board extending in a main scanning direction, which is perpendicular to a transport direction of the sheet 4, for example.

To compute image misalignment value used for correcting image misalignment, a correction-use pattern 29 (see FIG. 5) may be formed on the sheet transport belt 5 to detect image misalignment and the TM sensors 17, 18, 19 read the correction-use pattern 29 for each color to detect an image misalignment value between different images. After the TM sensors 17, 18, 19 detect the correction-use pattern 29, the correction-use pattern 29 is removed from the sheet transport belt 5 using a cleaning unit 20. Hereinafter, a term of "correction-use pattern" may be used as an image pattern used for correcting image misalignment. The correction-use pattern 29 and the correction-use patterns 29 may be used in following descriptions with a similar meaning.

Figure 3:
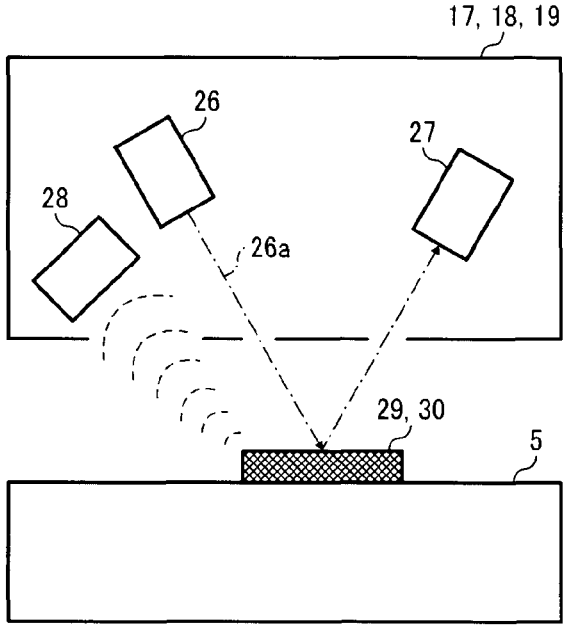
FIG. 3 illustrates a schematic configuration of principle of detection of correction-use pattern formed on a sheet transport belt by a sensor.
Figure 4:
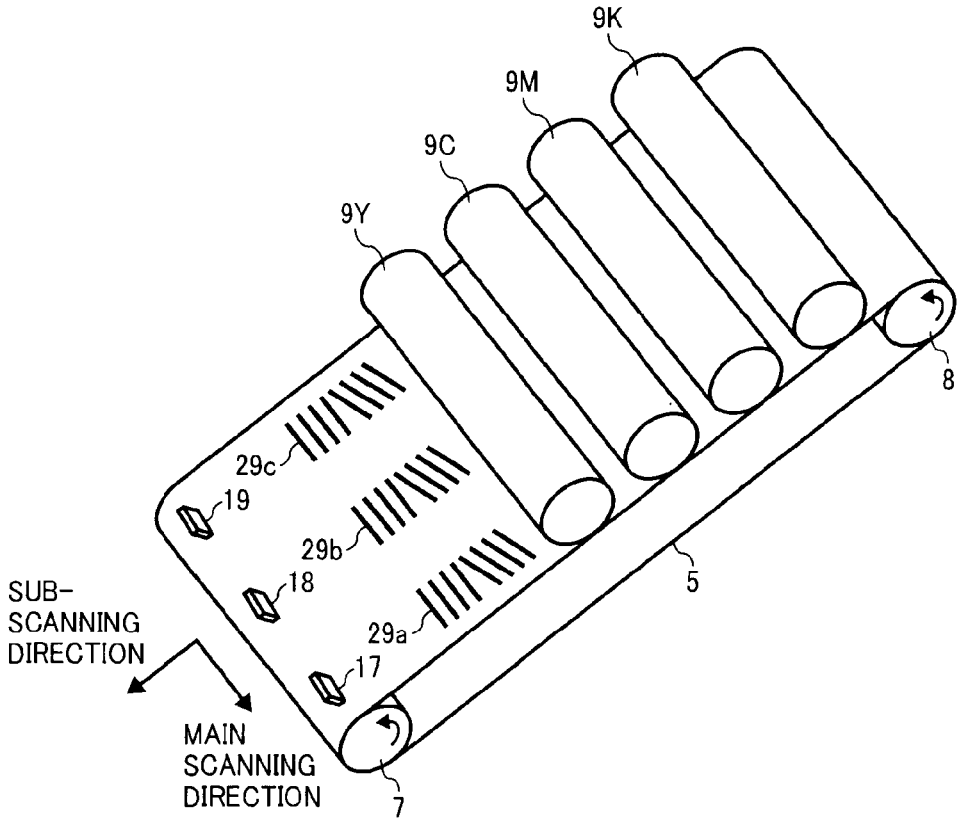
FIG. 4 illustrates a perspective view of the image forming unit, in which sensors, correction-use patterns, and photoconductor drums are illustrated.

FIG. 3 illustrates an expanded view of TM sensors 17, 18, 19 used as image detector, and FIG. 4 illustrates a schematic configuration for detecting correction pattern, in which the photoconductors 9, the sheet transport belt 5, the correction-use patterns 29, and the TM sensors 17, 18, 19 are disposed at given positions. The TM sensors 17, 18, 19 detect the correction-use patterns 29. As illustrated in FIG. 3, each of the TM sensors 17, 18, 19 may include a light generation unit 26, a regular reflection receiving unit 27, and a diffuse reflection receiving unit 28, for example.

The light generation unit 26 emits and irradiates a light beam 26*a* to the correction-use pattern 29 formed on the sheet transport belt 5. Then, light reflected including a regular reflected light component and a diffuse reflected light component may be received by the regular reflection receiving unit 27, by which the correction-use pattern 29 can be detected using the TM sensors 17, 18, 19.

Further, an adhesion amount correction pattern 30 can be formed on the sheet transport belt 5 and detected by the TM sensors 17, 18, 19. When the adhesion amount correction pattern 30 is detected, the regular reflection receiving unit 27 receives light reflected including a regular reflected light component and a diffuse reflected light component, and the diffuse reflection receiving unit 28 receives the diffuse reflected light.

As illustrated in FIG. 4, the first and third TM sensors 17 and 19 may be disposed at both end side in a main scanning direction, and the second TM sensor 18 may be disposed at a middle in the main scanning direction. Correction-use patterns 29*a*, 29*b*, 29*c* may be formed and detected by each of the TM sensors 17, 18, and 19. Further, the adhesion amount correction pattern 30 may be formed and detected by only the second TM sensor 18, in which the first and third TM sensors 17 and 19 may not need to include the diffuse reflection receiving unit 28. The correction-use patterns 29*a*, 29*b*, 29*c* can formed as illustrated in FIG. 4. Each of the correction-use patterns 29*a*, 29*b*, 29*c* may include one or more sets of color patterns to be used for computing image misalignment values, which is usable for correcting image misalignment. The TM sensors 17, 18, 19 including the regular reflection receiving unit 27 may be used as a pattern detector.

Figure 5:
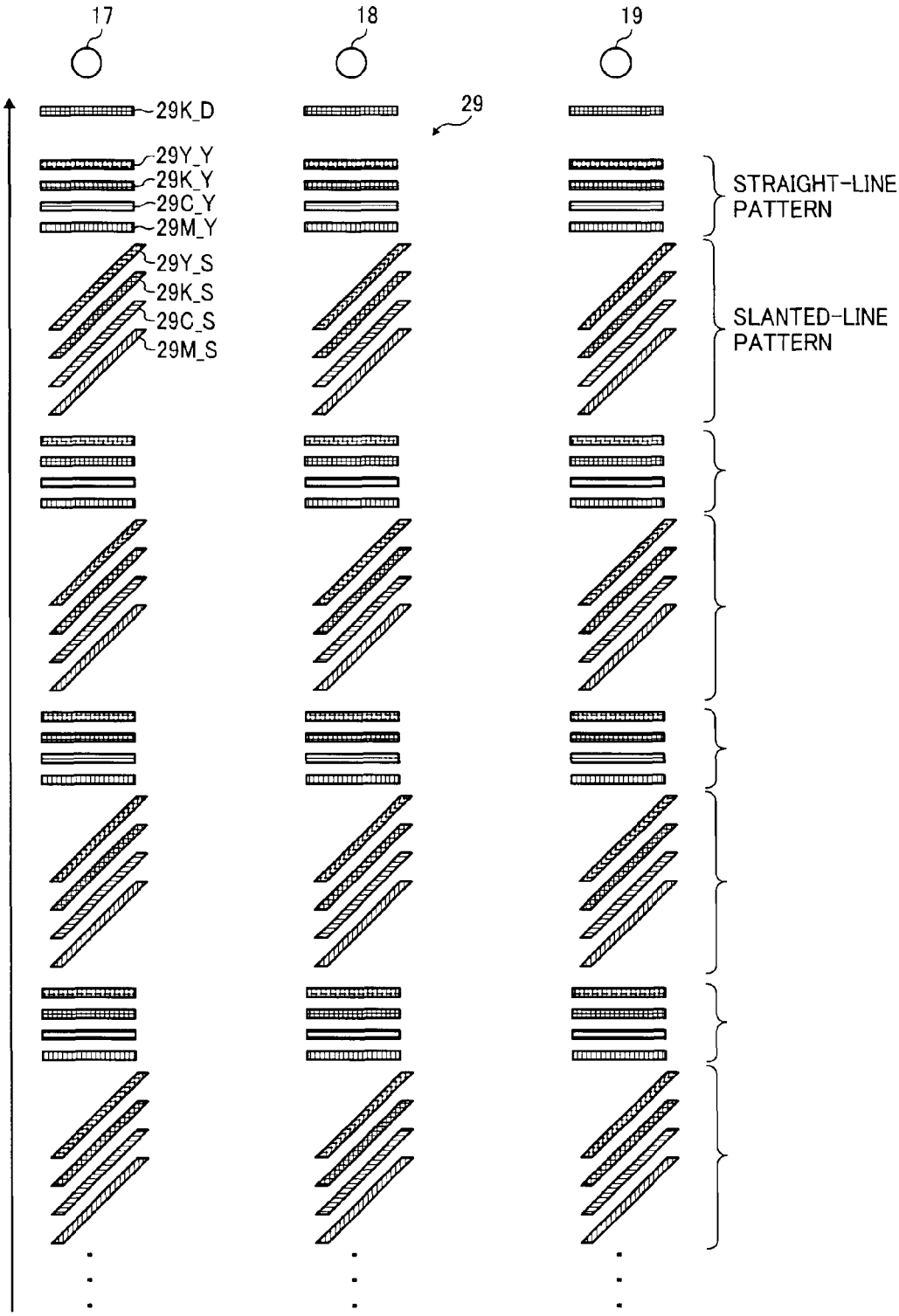
FIG. 5 illustrates example correction-use patterns used for first example embodiment.

FIG. 5 illustrates one example of correction-use pattern 29. The correction-use pattern 29 may use eight correction patterns formed of K, M, C, Y colors as one set of correction-use pattern. Specifically, straight-line patterns 29K_Y, 29M_Y, 29C_Y, 29Y_Y, and slanted-line patterns 29K_S, 29M_S, 29C_S, 29Y_S may be formed on the sheet transport belt 5. As illustrated in FIG. 5, the slanted-line patterns 29K_S, 29M_S, 29C_S, 29Y_S may extend from a left side to a right side while the right side is set higher than the left side for slanted-line patterns. Such correction-use pattern 29 may be formed at a position corresponding to the TM sensors 17, 18, 19, and the correction-use pattern 29 may be formed with a plurality of patterns in a sub-scanning direction.

Further, the correction-use pattern 29 may include a detection-timing-adjustment pattern 29K_D at the leading head of the correction-use pattern 29 as illustrated in FIG. 5. The TM sensors 17, 18, 19 may detect the detection-timing-adjustment pattern 29K_D before detecting the straight-line patterns (29K_Y, 29M_Y, 29C_Y, 29Y_Y) and the slanted-line patterns (29K_S, 29M_S, 29C_S, 29Y_S). The TM sensors 17, 18, 19 may be used to detect the detection-timing-adjustment pattern 29K_D to determine a distance deviation between an exposing position on a photoconductor and the TM sensor position. Based on the detected distance deviation, a detection timing of pattern can be adjusted. In such process, a time of starting formation of pattern 29K_D (exposing process using a laser diode LD) may be referred as time T0, and a time when the TM sensor (image detector) starts to detect the pattern 29K_D may be referred as time T1. If a distance between the exposing position on a photoconductor and the detection position by the TM sensor is a given value such as 200 mm, and the line speed is set to a given value such as 100 mm/sec, a time difference of T1−T0 becomes 2 seconds, which may be a theoretical value for time difference between the exposing position and the TM sensor. However, the distance between the exposing position and the TM sensor may deviate due to some factors such as deviation of assembly angle of TM sensor, deviation of LD position, belt elongation, or the like. If the time difference of T1−T0 becomes 2.1 seconds by an actual detection, the error with respect to the theoretical value becomes 0.1 sec. Based on such detection, a detection timing of pattern can be adjusted for the amount of detected error. With such a process, the straight-line patterns 29K_Y, 29M_Y, 29C_Y, 29Y_Y and the slanted-line patterns 29K_S, 29M_S, 29C_S, 29Y_S can be detected reliably at a suitable timing. Hereinafter, the straight-line patterns may be attached with reference "_Y," and the slanted-line patterns may be attached with "_S."

Figure 6:
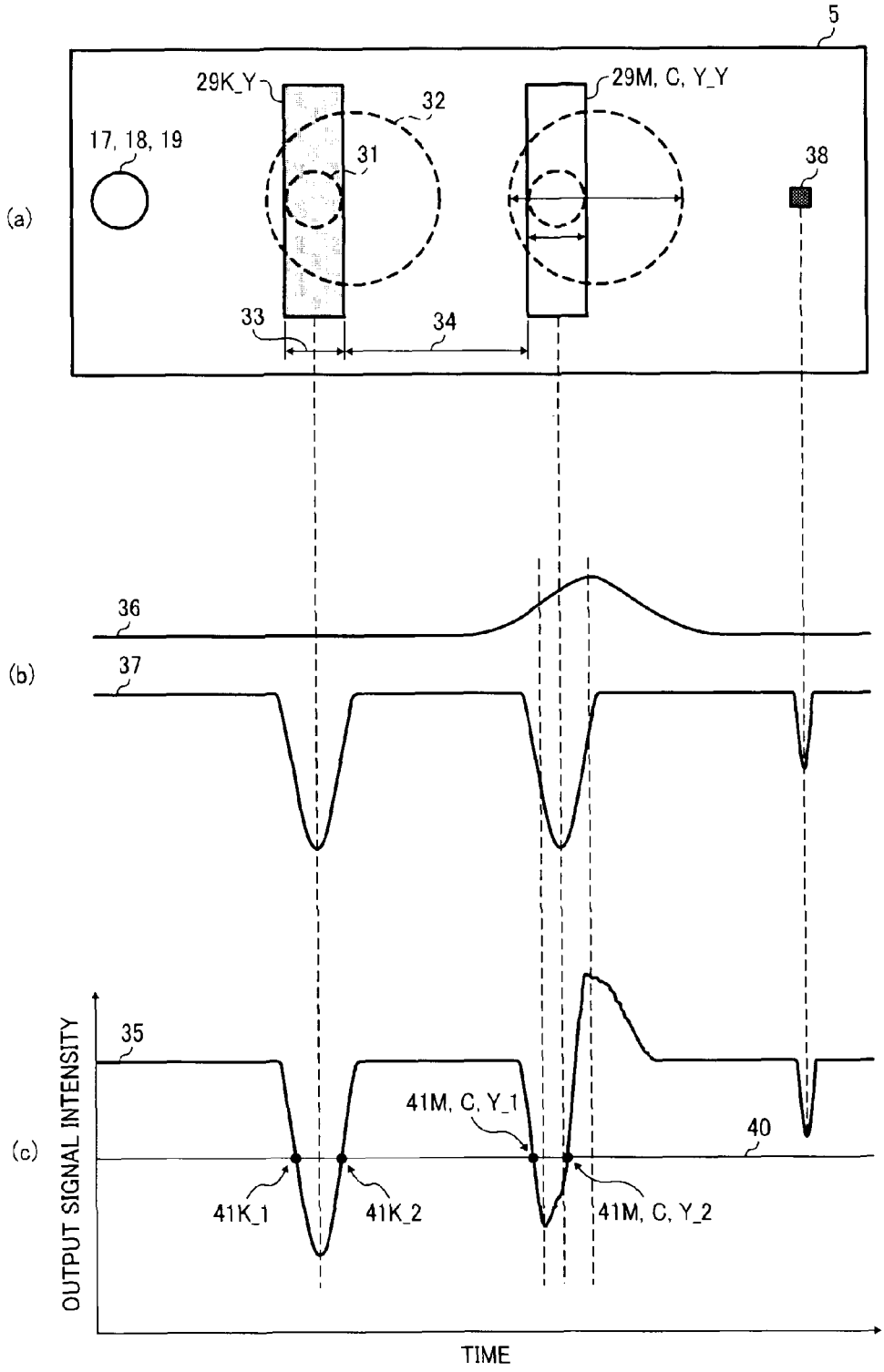
FIG. 6 illustrates a principle of detection of correction-use patterns of FIG. 5, FIG. 6(*a*) illustrates an example relation of correction-use pattern, spot diameter of irradiation light, and spot diameter of regular reflected light receiving unit, FIG. 6(*b*) illustrates an example relation of diffusion light component and regular reflected light component included in a received light signal reflected from a correction-use pattern, FIG. 6(*c*) illustrates an output signal of regular reflected light receiving unit and a method of computing a center position of correction-use pattern.

FIG. 6 illustrates a principle of detection of correction-use patterns of FIG. 5. FIG. 6(*a*) illustrates an example relation of correction-use pattern, spot diameter of irradiation light, and spot diameter of regular reflected light receiving unit. FIG. 6(*b*) illustrates an example relation of diffusion light component and regular reflected light component included in a received light signal reflected from a correction-use pattern. FIG. 6(*c*) illustrates output signal of regular reflected light receiving unit and a method of computing a center position of correction-use pattern.

As illustrated in FIG. 5, the correction-use pattern 29 may be formed on the sheet transport belt 5 for each of K, M, C, Y. In first example embodiment, each of the straight-line patterns 29K_Y, 29M_Y, 29C_Y, 29Y_Y has a pattern width 33 in a sub-scanning direction, and the straight-line patterns 29K_Y, 29M_Y, 29C_Y, 29Y_Y are formed with an interval 34 between adjacent straight-line patterns as illustrated in FIG. 6(*a*).

The light generation unit 26 may emit a light beam having a spot diameter 32 on the correction-use pattern 29, and the regular reflection receiving unit 27 may detect a spot diameter 31 as illustrated in FIG. 6(*a*). FIG. 6(*a*) illustrates a principle of detection of the correction-use pattern 29, in which given combination of the correction-use patterns can be used for detecting image misalignment.

The light generation unit 26 emits the light beam 26*a* onto the correction-use pattern 29 formed on the sheet transport belt 5, and then the light beam 26*a* reflects from the correction-use pattern 29 as reflected light. The regular reflection receiving unit 27 receives the reflected light reflected from the sheet transport belt 5, which may include a regular reflected light component and a diffuse reflected light component.

When the sheet transport belt 5 moves under such condition, the TM sensors 17, 18, 19 may receive a diffuse-reflected light component 36 and the regular-reflected light component 37 as illustrated in FIG. 6(*b*), in which a received signal of the diffuse-reflected light component 36 (which may be referred to as diffuse-reflected light component 36) and a received signal of regular-reflected light component 37 ((which may be referred to as regular-reflected light component 37) are shown. Further, as illustrated in FIG. 6(*c*), the regular reflection receiving unit 27 of the TM sensors 17, 18, 19 may output an output signal 35. In FIG. 6(*c*), the vertical axis of graph indicates an output signal intensity detected by the regular reflection receiving unit 27 and the horizontal axis of graph indicates time.

A CPU 49, to be described later, may determine that pattern edges 41K_1, 41K_2, 41M,C,Y_1, 41M,C,Y_2 are detected at positions where a detection wave pattern of the output signal 35 crosses a thresh line 40. As illustrated in FIG. 6(*c*), such edge values for each color may be used to determine an image position of each of colors. In an example embodiment, intensity of the regular-reflected light component 37 detected by the regular reflection receiving unit 27 indicates reflected light intensity of regular reflected light from a surface of sheet transport belt 5.

A difference between the reflected light intensity obtained from a surface of sheet transport belt 5 and the reflected light intensity obtained from the correction-use pattern 29 may be computed as a kind of peak value. Based on the peak value, a one-half (½) of the peak value may be set as the thresh line 40, for example. As such, the thresh line 40 may be set at one-half (½) of the peak value.

As illustrated in FIG. 6(*b*), the diffuse-reflected light component 36 may be included in a received light signal. The diffuse-reflected light component 36 does not reflect from a surface of the sheet transport belt 5 and the correction-use pattern 29K_Y (K color), but reflects from the correction-use patterns 29M, 29C, 29Y_Y (M, C, Y color). As illustrated in FIG. 6(*b*), the regular-reflected light component 37 is included in a received light signal. The regular-reflected light component 37 reflects from a surface of the sheet transport belt 5 strongly, but does not reflect any of the correction-use pattern 29. As such, a regular reflected light can be reflected from the sheet transport belt 5 continuously but may not reflect from the correction-use pattern 29. Accordingly, when the correction-use pattern 29 comes under a detection area of the regular reflection receiving unit 27, a regular reflected light may not be reflected from the correction-use pattern 29, but a position of the correction-use pattern 29 can be detected because the correction-use pattern 29 is surrounded (and defined) by a belt surface area, by which a position of correction-use pattern 29 can be determined.

As illustrated in FIG. 6(*c*), when the correction-use pattern 29 is detected, the output signal 35 of the regular reflection receiving unit 27 becomes a superimposed signal of the regular-reflected light component 37 and the diffuse-reflected light component 36. When such superimposed reflected light is detected, a signal-to-noise (S/N) ratio for the color pattern detection becomes smaller than a S/N ratio for K pattern detection. In such situation, edges of correction-use pattern 29 can be detected reliably by taking at least one of following measures.

1) Maintain an intensity of the light beam 26*a* of the light generation unit 26 may at a constant value during an execution of one correction operation of image misalignment and/or one correction operation of adhered amount.

2) Adjust intensity of light beam 26*a* used as irradiation light to a suitable value for each time the correction of image misalignment and/or correction of adhered amount is executed.

3) When no pattern is formed on the sheet transport belt 5, the sheet transport belt 5 is irradiated by the light beam 26*a* while varying the intensity of light beam 26*a* to obtain various detection results of the regular reflection receiving unit 27. Based on such detection results, the intensity of the light beam 26*a* may be determined to a given level so that regular reflected light reflected from the sheet transport belt 5 can be set to a desired level.

4) If adjustment time needs to be shorter, a given fixed value may be used for the intensity of the light beam 26*a*.

As for the TM sensors 17, 18, 19, the correction-use pattern 29 can be detected correctly by adjusting an alignment of the light generation unit 26 and the regular reflection receiving unit 27. If such alignment is deviated due to mechanical tolerance or assembly error, a peak position of wave pattern of regular-reflected light component 37 may deviate from a peak position of wave pattern of diffuse-reflected light component 36 for the straight-line patterns 29M_Y, 29C_Y, 29Y_Y as illustrated in FIG. 6(*b*).

As for output signal of the regular reflection receiving unit 27, followings can be observed (see wave pattern of regular-reflected light component 37 and output signal 35).

As for the straight-line pattern 29K, an actual center position of pattern on the regular-reflected light component 37 and a peak position of output signal 35 can be matched. The actual center position of pattern is a center of detected wave pattern of regular-reflected light component 37, and the peak position of output signal 35 is a greatest value of peak.

However, as for the straight-line patterns 29M, 29C, 29Y, an actual center position of pattern and peak position of output signal may be deviated each other (see wave pattern of regular-reflected light component 37 and output signal 35). The actual center position of pattern on detected wave pattern of regular-reflected light component 37 is not matched to the peak position of output signal 35.

As a result, detection position of color pattern may have some positional error, by which position of color pattern 29 cannot be detected correctly, and the S/N ratio becomes lower. Such detection error and lower S/N ratio during a color pattern detection process may become greater when the slanted-line patterns 29K_S, 29M_S, 29C_S, 29Y_S are detected compared to the straight-line patterns 29K_Y, 29M_Y, 29C_Y, 29Y_Y.

Further, as illustrated in FIG. 6(*a*), if a disturbance 38 such as belt scratch or adhered material exists on the sheet transport belt 5, such disturbance 38 may be miss-detected as the correction-use pattern 29.

When the light beam 26*a* is irradiated onto the disturbance 38, a reflection level of regular reflected light from the disturbance 38 may be observed as a peak as illustrated in FIG. 6(*b*), which may indicate that a surface area for such peak may not be a smooth face. If light is reflected from such non-smooth face, a reflection level of regular reflected light from such non-smooth face may become smaller compared to a reflection level of regular from a smooth face of the sheet transport belt 5. If the reflection level of the disturbance 38 crosses and passes the thresh line 40, an image detector may miss-detect the disturbance 38 as the correction-use pattern 29. To prevent such miss-detection, the S/N ratio of the correction-use pattern 29 may need to be set greater so that a level of thresh line 40 may can be set greater. In FIGS. 6(*b*) and 6B(*b*), when the thresh line 40 becomes greater, the thresh line 40 is set at a lower side in graph.

To detect the correction-use pattern 29 reliably, detection error of color pattern (correction-use pattern 29) may need to be set smaller and the S/N ratio of color pattern detection may need to be set greater.

A difference between the reflection level of regular reflection light component reflected from a color pattern and the reflection level of the sheet transport belt 5 may become greatest when the pattern width 33 of the correction-use pattern 29 in sub-scanning direction is equal to or greater than the spot diameter 31 of the regular reflection receiving unit 27. The spot diameter 31 is defined by a light receiving hole formed for the regular reflection unit 27, wherein the light receiving hole has a given size. The regular reflection receiving unit 27 may receive a regular reflected light via the light receiving hole. Accordingly, if the regular reflection receiving unit 27 receives the regular reflected light using the light receiving hole entirely, the regular reflection receiving unit 27 can output a signal that the reflection level of regular reflected light from the transport belt 5 becomes the greatest. Accordingly, when the pattern width 33 is equal to or greater than the spot diameter 31, a difference of the reflection level of regular reflected light from the transport belt 5 and the correction-use pattern 29 becomes the greatest.

On one hand, the smaller the pattern width 33 in sub-scanning direction, the smaller the reflection level of the diffuse-reflected light component 36 from the correction-use pattern 29.

Accordingly, when the pattern width 33 of the correction-use pattern 29 in sub-scanning direction is set to equal to the spot diameter 31 of the regular reflection receiving unit 27, the S/N ratio of reflected light obtained using the correction-use pattern 29 may become greatest for a detection process.

Accordingly, the smallest portion of the pattern width 33 of correction-use pattern 29K, 29M, 29C, 29Y_Y in sub-scanning direction may be set substantially equal to the spot diameter 31 of the regular reflection receiving unit 27 such as for example 0.6 mm. Further, the smallest portion of the pattern width 33 of the correction-use pattern 29K, 29M, 29C, 29Y_S (i.e., slanted line) may be also set substantially equal to the spot diameter 31 of the regular reflection receiving unit 27 such as for example 0.6 mm.

In a configuration of example embodiment, the spot diameter 32 of light beam 26*a* (use as irradiation light) may be set to a given value such as for example 2 mm or so. If one light beam irradiates two correction-use patterns 29 at the same time, diffusion light may be reflected from the two patterns at the same time, by which the correction-use patterns 29 may not be detected correctly. To prevent such miss-detection, the smallest portion of the interval 34 of the adjacent straight-line correction-use patterns 29 (e.g., straight-line patterns 29K, 29M, 29C, 29Y_Y) is set to a given value such as for example 2 mm or greater, and further, the smallest interval between the adjacent slanted-line correction-use patterns 29 (e.g., slanted-line patterns 29K, 29M, 29C, 29Y_S) are set to a given value such as 2 mm or greater, for example.

The CPU 49 may implement correction of image misalignment, using a given computation, based on output signals of the TM sensors 17, 18, 19, which obtains data from the correction-use pattern 29 illustrated in FIG. 5. Specifically, the CPU 49 computes image position of the straight-line patterns 29K_Y, 29M_Y, 29C_Y, 29Y_Y (see FIG. 5) using detection results obtained for the correction-use pattern 29, and based on such detection results, the CPU 49 computes registration deviation value and skew in sub-scanning direction.

Further, in addition to such detection and computation of image position of the straight-line patterns 29K_Y, 29M_Y, 29C_Y, 29Y_Y, the CPU 49 computes image position of the slanted-line patterns 29K_S, 29M_S, 29C_S, 29Y_S using detection results obtained for the correction-use pattern 29, and based on such detection results, the CPU 49 computes magnification error in main scanning direction, registration deviation value in main scanning direction. As such, the CPU 49 implements correction of image misalignment based on detection results for the correction-use pattern 29.

Such detected image misalignment can be corrected as below.

1) skew can be corrected by adjusting an inclination angle of deflection mirror disposed in the exposure unit 11 or the exposure unit 11 as a whole using an actuator or the like, for example.
2) registration deviation in sub-scanning direction can be corrected by controlling a write-start timing of scan line and face phase of polygon mirror, for example.
3) magnification error in main scanning direction can be corrected by changing an image writing frequency, for example.
4) registration deviation in main scanning direction can be corrected by changing a write-start timing of main scanning line.

Figure 7:
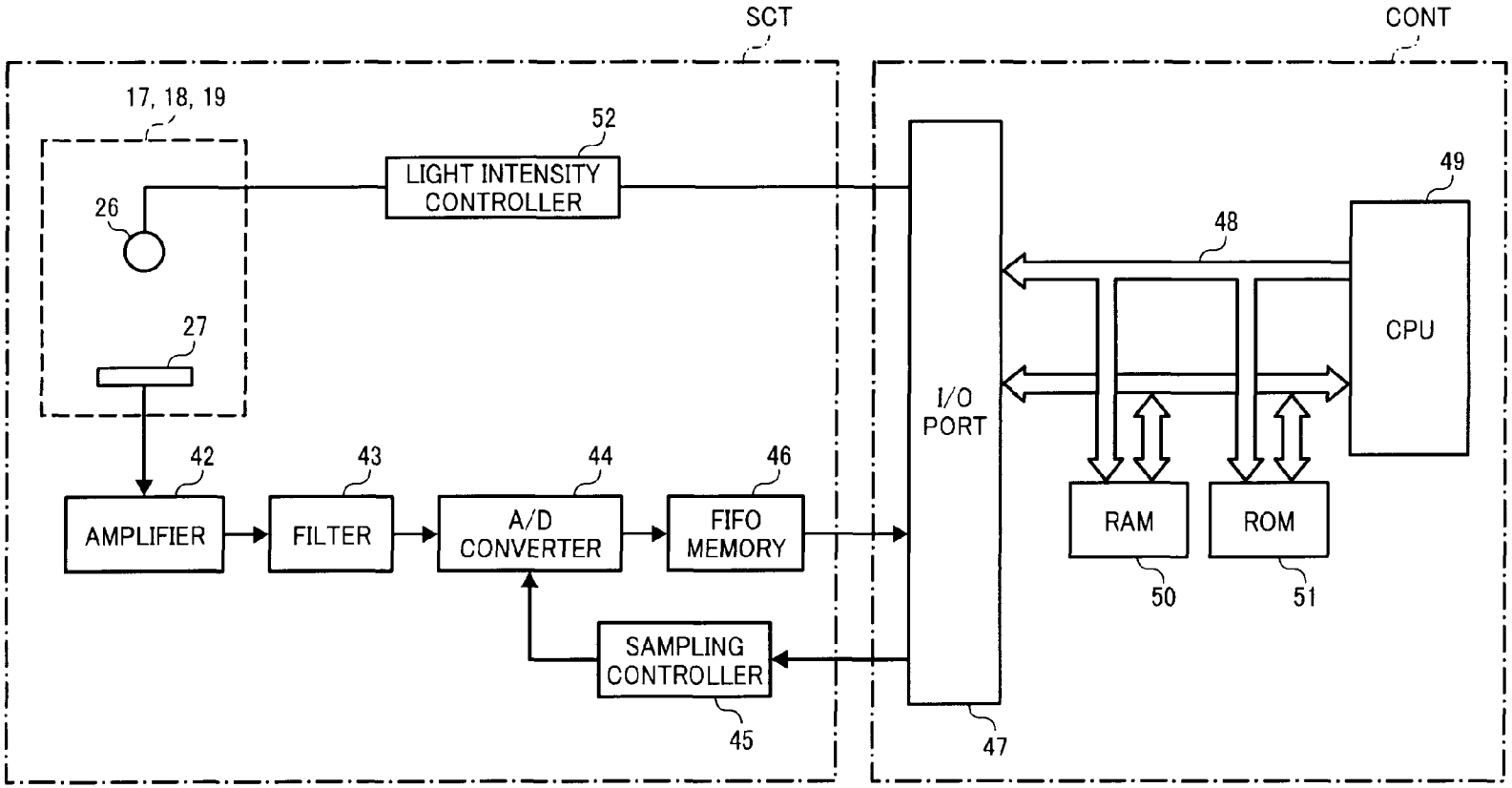
FIG. 7 illustrates a block diagram of misalignment correction circuit used for computing a correction amount usable for correcting image misalignment.

FIG. 7 illustrates a block diagram of circuit configuration for a misalignment correction circuit. The misalignment correction circuit processes detected data to compute correction amount required for correcting image misalignment. As illustrated in FIG. 7, the misalignment correction circuit may include a control circuit "CONT" and a detection circuit "SCT." The detection circuit SCT is connected to the control circuit CONT via an input/output (I/O) port 47 disposed in the control circuit CONT, for example.

The detection circuit SCT may include an amplifier 42, a filter 43, an analog/digital (A/D) converter 44, a sampling controller 45, a first-in first-out (FIFO) memory 46, and a light intensity controller 52, and may be connected to the TM sensors 17, 18, 19. The control circuit CONT may include the CPU 49, a random access memory (RAM) 50, a read only memory (ROM) 51, and the I/O port 47, which are connected with each other via a bus 48.

In such controller configuration, the output signal of the regular reflection receiving unit 27 disposed in the TM sensors 17, 18, 19 is amplified by the amplifier 42. Then, the filter 43 passes only signal corresponding to detected lines (or patterns), and the A/D converter 44 converts the signal from analog data to digital data. The sampling controller 45 controls data sampling, and sampled data is stored in the FIFO memory 46. When detection of one set of the correction-use pattern 29 is completed, the stored data is loaded to the CPU 49 and RAM 50 via the I/O port 47 and bus 48. Then, the CPU 49 processes the data to compute the above described deviation values such as image misalignment value.

The ROM 51 may store programs for computing the above described deviation values, and programs to control correction of image misalignment and the image forming apparatus according to an example embodiment.

The CPU 49 may function as an image misalignment detector. The CPU 49 may monitor signals of the regular reflection receiving unit 27 at suitable timing. The CPU 49 controls light intensity of light beam 26*a* using the light intensity controller 52 so that a pattern detection can be executed in a effective manner even when the sheet transport belt 5 and/or the light generation unit 26 may degrade. Accordingly, intensity level of light signal received from the regular reflection receiving unit 27 can be constantly maintained at a given level.

The RAM 51 may be used as a working area and data buffer when the CPU 49 executes programs. As such, the CPU 49 and the ROM 51 may function as a control unit for controlling the image forming apparatus 100 as a whole.

As such, the correction-use pattern 29 is formed, and the TM sensors 17, 18, 19 detect the correction-use pattern 29 to conduct correction of image misalignment among different color images, by which the image forming apparatus 100 can output high quality images.

To further reduce image misalignment and to produce high quality image, a detection error of correction-use patterns 29 may need to become further smaller. In an example embodiment, an image misalignment correction unit may utilize light property of LED, which is used as a light source. The image misalignment correction unit may be a combination of TM sensor, a belt (e.g., transport belt) formed with correction pattern, a central processing unit (CPU), which may store shape of patterns and compute a correction value based on detection result of patterns, for example. Specifically, LED light can emit substantially single color light, which means light having a narrower wavelength range can be emitted from LED compared to other light sources. Specifically, a light beam having a complementary color relation with a given one color of correction-use patterns 29 may be irradiated to the correction-use patterns 29. The light generation unit 26 emits and irradiates such light beam having a complementary color relation to the given correction-use pattern 29 so that the concerned color pattern can be corrected with higher precision.

Figure 8:
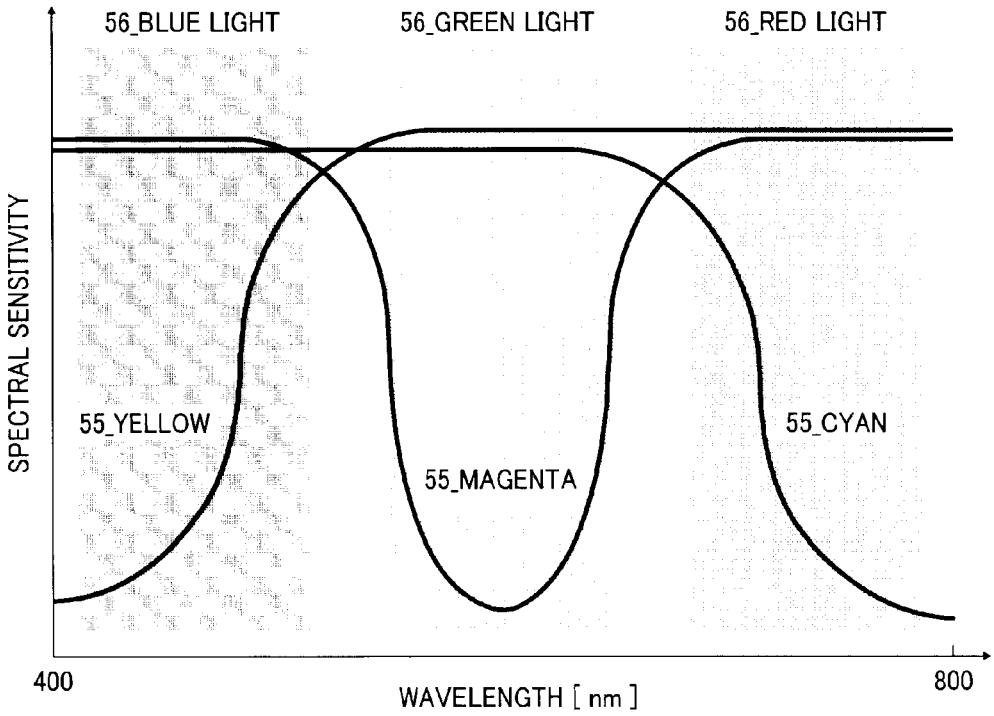
FIG. 8 illustrates a spectral sensitivity characteristic curve of LED light irradiated to color pattern.

FIG. 8 illustrates characteristic curve of spectral sensitivity when a light source LED emits light to color patterns such as correction-use pattern 29, in which each curve may indicate intensity of light component 36. By referring such characteristic curve, principal of reducing detection error is described. FIG. 8 illustrates the characteristic curve schematically.

In the characteristic curve of FIG. 8, the vertical axis represents spectral sensitivity when a LED light is irradiated onto each of color images (Y, M, C images), and the horizontal axis represents wavelength of LED light. The characteristic curve of FIG. 8 illustrates spectral sensitivity for visible light, which means the wavelength range is set from 400 nm to 800 nm, for example. A curve of 55_Yellow indicates spectral sensitivity when a light beam is irradiated on a yellow toner pattern. As for the curve of 55 Yellow, a peak may be around 56_Blue light (wavelength: 435 nm to 480 nm). This indicates that blue light can be absorbed by a yellow pattern, which means blue light and yellow image have a complementary color relation.

Similarly, as for a curve of 55_Magenta, a peak may be around 56_Green light (wavelength: 500 nm to 560 nm), and as for a curve of 55_Cyan, a peak may be around 56_Red (wavelength: 610 nm to 750 nm), for example, and a complementary color relation is set similary.

As such, when the LED irradiation light and a color pattern have a complementary color relation, an irradiation light is absorbed by the color pattern, by which diffuse reflected light component may not be reflected from the color pattern. Accordingly, a ratio of diffuse reflected light component included in regular reflected light becomes too small.

The reflected light reflected from a black pattern does not include a diffuse reflected light component for any irradiation light having any wavelength.

Accordingly, when a light source LED emits an irradiation light having a wavelength in visible light range, detection error of correction-use pattern may be reduced for the black pattern and a color pattern having a complementary color relation with the irradiation light. Accordingly, an image misalignment between such two colors (e.g., black and another color) can be corrected with higher precision.

However, under such configuration, an image misalignment between black and other color, which has no complementary color relation with the visible light emitted from the light source LED, may not be conducted with an enhanced manner. Accordingly, such configuration may not be effective for correcting image misalignment between four colors, but can be effective for correcting image misalignment between two colors.

Such image misalignment correction for two colors may be used when conducting an image misalignment correction in main scanning direction during a lower speed printing, which may include a factor of detection delay value by synchronization detector.

Typically, when the synchronization detector 25 (see FIG. 2) receives the laser beam 14, the synchronization detector 25 may need some time to generate and output a detection signal after receiving the laser beam 14. Such time may be referred to as detection delay value having a given time.

Such detection delay value becomes a same value for exposing colors using a same face of the polygon mirror 22 (e.g., black K and magenta M, cyan C and yellow Y in FIG. 2), by which relative image misalignment value becomes zero "0" for such colors.

In contrast, as for exposing colors using opposed faces of the polygon mirror 22 (e.g., black K/Magenta M, cyan C/yellow Y in FIG. 2), image misalignment directions for such colors become opposite directions. Accordingly, a relative image misalignment value for such colors can be computed by multiplying the detection delay value (or time) with a rotation speed of polygon motor, driving the polygon mirror 22 (rotation speed of the polygon mirror 22), and then multiplying two (relative image misalignment value=detection delay value×rotation speed×2)

Such image misalignment value can be corrected when correction of image misalignment is executed, by which such image misalignment value may not become problems for a normal image printing operation.

Because the polygon motor and the polygon mirror 22 shares one shaft to rotate, a rotation speed or rotation number of the polygon motor may mean a rotation speed or rotation number of the polygon mirror 22.

In an example embodiment, the image forming apparatus 100 may be employed with a plurality of printing modes, and a printing speed may be changeable depending on printing modes. For example, during a high quality printing mode or a thick paper printing mode (i.e., slower printing speed), a printing speed may be set to one half (½) of normal printing speed under the normal printing mode for image forming operation, in which a rotation number (or speed) of the polygon mirror 22 (or polygon motor), the drive roller 7, and the photoconductor drum 9 may be set to one half (½). Although the rotation speed of polygon mirror 22 may decrease as such, the detection delay value for slower printing speed may be same as normal printing speed under the normal printing mode. As such the detection delay value may be constant because such delay is caused by electrical factors of circuit configuration of semiconductor.

As such, when the slower printing speed is used, the rotation number (or speed) of polygon mirror 22 changes while the detection delay value (or time) is not changed (i.e., constant value), by which image misalignment value may change due to the detection delay value.

Typically, a correction amount for image misalignment of each of colors may be computed based on a rotation number of the polygon mirror 22 at a normal printing speed under a normal printing mode. Accordingly, if the printing speed is changed to a slower printing speed, an actual image misalignment value may not be matched to an correction amount (e.g., gap may occur between an actual image misalignment value and correction amount), by which image misalignment may occur on an output image.

Such image misalignment may occur only in a rotation direction the polygon mirror 22, which means such image misalignment may occur only in a main scanning direction, which may be called as image misalignment in main scanning direction. Further, Such image misalignment in main scanning direction may occur for exposing colors using opposed faces of polygon mirror 22 (e.g., black K/magenta M, cyan C/yellow Y).

Such image misalignment in main scanning direction can be corrected as below. For example, an image misalignment correction process is executed to compute a correction amount difference by varying the rotation number of polygon mirror 22 from a normal printing speed under a normal printing mode in advance (e.g., rotation number may be varied to slower speed). Then, the correction amount obtained for varied speed condition may be compared with image misalignment correction amount for normal printing mode, and a difference of such correction amount is stored.

The correction amount difference may be a difference between a correction amount under normal speed printing and a correction amount for correcting image misalignment when the rotation number is varied. For example, if it is known that a cyan image can be corrected by a correction amount of +10 dots under normal speed printing, and a cyan image can be corrected by a correction amount of +12 dots under slower speed printing, the correction amount difference becomes 2 dots (=12−10). Such correction amount difference of 2 dots may be applied when a slower speed printing is conducted after a most-recent normal speed printing. For example, if a correction amount of most-recent normal speed printing is 20 dots, and then a slower speed printing is conducted, the correction amount difference of slower speed printing (2 dot) may be added to the correction amount of 20 dots.

Such correction of image misalignment under such varying or changed rotation number of polygon mirror 22 may not be required for between black K and magenta M, and between cyan C and yellow Y in a configuration illustrated in FIG. 2. Accordingly, such correction of image misalignment under the changed rotation number of polygon mirror 22 may be conducted one of black K and magenta M with one of cyan C and yellow Y. With such configuration, even when the rotation number polygon mirror 22 is changed, a correction of image misalignment using a light source LED emitting visible light range can be conducted with an enhanced precision.

Figure 9:
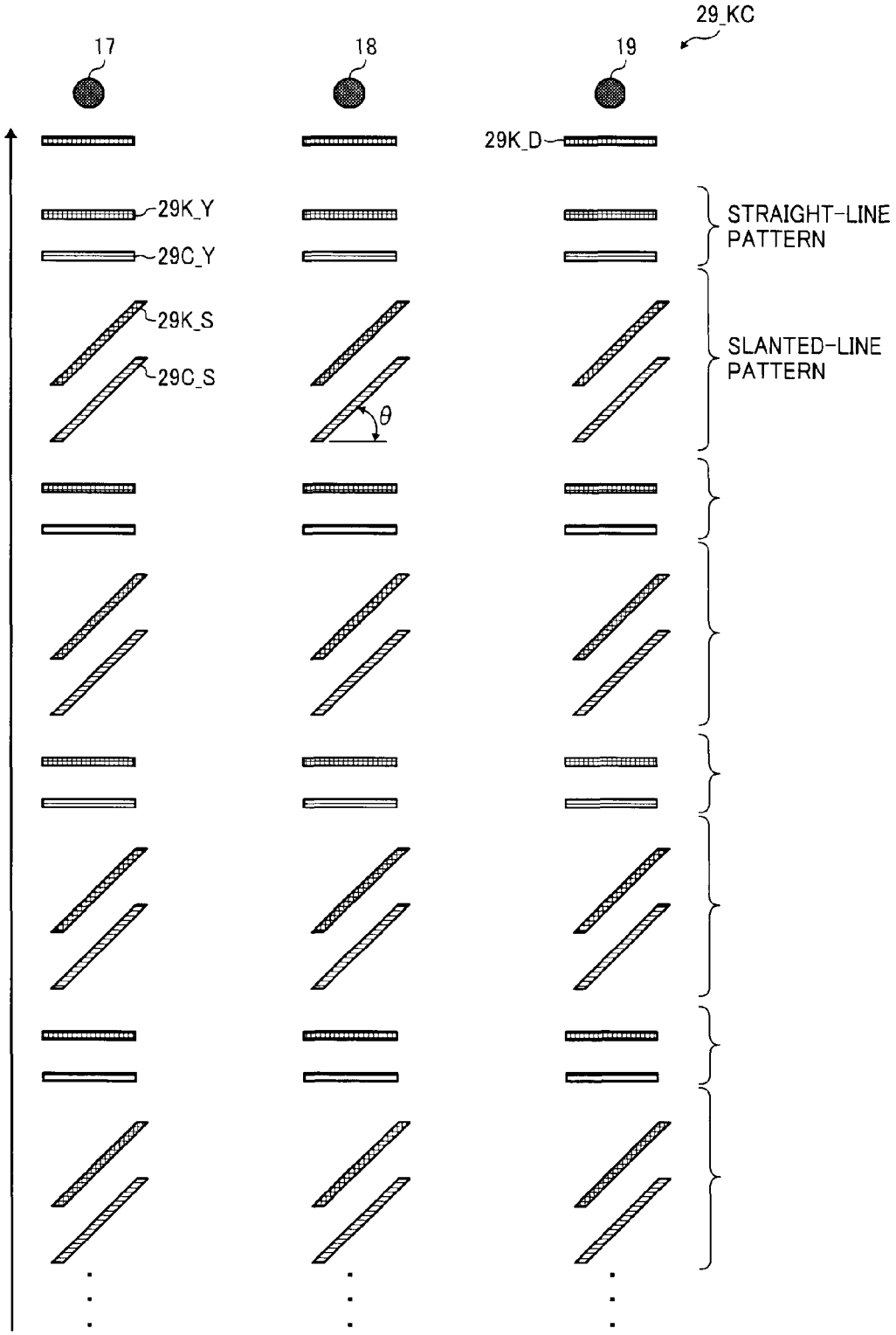
FIG. 9 illustrates correction-use patterns for black and cyan used for a first example embodiment.

FIG. 9 illustrates the correction-use patterns 29_KC for black and cyan. When the correction-use pattern 29_KC are formed and detected, the rotation number of the polygon mirror 22, the drive roller 7, and the photoconductor drum 9 may be set to one-half (½) of the normal printing speed under the normal printing mode.

The correction-use pattern 29_KC may include the straight-line patterns 29K_Y, 29C_Y, and the slanted-line patterns 29K_Y, 29C_S for black K and cyan C (i.e., two colors), in which one-set pattern includes four line patterns. The slanted-line patterns may be inclined from left to right at an inclination angle θ=45° in sub-scanning direction, for example. As illustrated in FIG. 9, such patterns may be prepared with a plurality of sets in sub-scanning direction, and such patterns may be detected by the TM sensors 17, 18, 19. Further, the correction-use pattern 29_KC may include a detection-timing-adjustment pattern 29K_D at the leading head of patterns. In example embodiments, the straight-line patterns may be used as a first orientation pattern extending at an inclination angle in the sub-scanning direction while the slanted-line patterns be used as a second orientation pattern extending at an inclination angle θ2 in the sub-scanning direction, in which θ1=0° (meaning extending in main scanning direction), and θ2=45°, for example.

Figure 10:
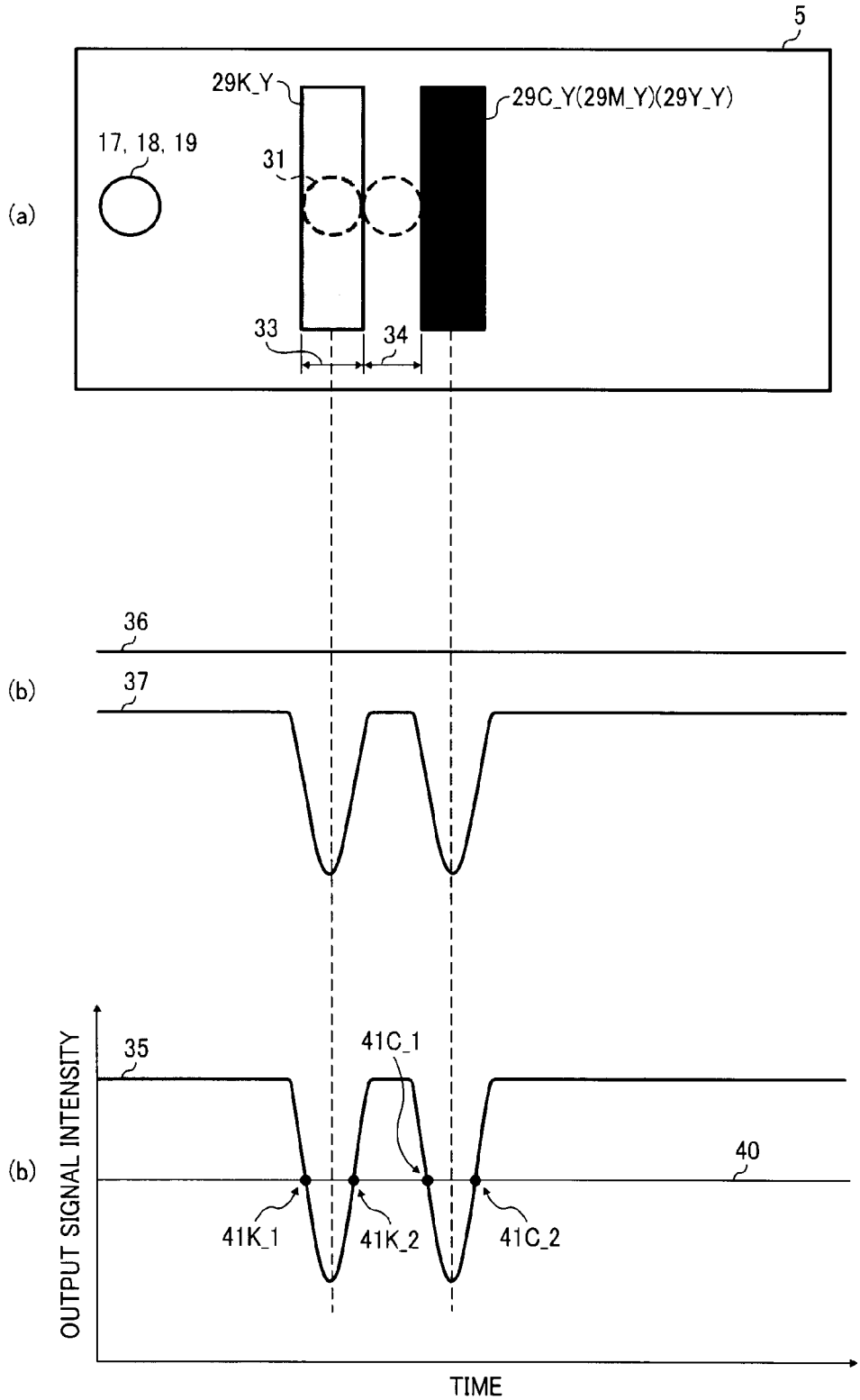
FIG. 10 illustrates a principle of detection of correction-use patterns of FIG. 9.

FIG. 10 illustrates a principle of detection of correction-use patterns of FIG. 9, wherein the principal of detection is similar to the above-described principle of detection with reference to FIG. 6. FIG. 10(*a*) illustrates an example relation of correction-use pattern, spot diameter of irradiation light, and spot diameter of regular reflected light receiving unit. FIG. 10(*b*) illustrates an example relation of diffusion light component and regular reflected light component included in a received light signal reflected from a correction-use pattern. FIG. 10(*c*) illustrates output signal of regular reflected light receiving unit and a method of computing center position of correction-use pattern.

The TM sensors 17, 18, 19 may include the light generation unit 26 having a light source such as LED, which emits a light beam of red light having a wavelength of 660 nm, for example. As illustrated in FIG. 10(*b*), a diffuse-reflected light component 36 may not reflect from the correction-use pattern 29K_Y for black, and the correction-use pattern 29C_Y for cyan whereas the regular-reflected light component 37 may not reflect from the correction-use pattern 29. As such, a regular reflected light can be reflected from the sheet transport belt 5 continuously but may not reflect from the correction-use pattern 29. Accordingly, when the correction-use pattern 29 comes under a detection area of the regular reflection receiving unit 27, a regular reflected light may not be reflected from the correction-use pattern 29, but a position of the correction-use pattern 29 can be detected because the correction-use pattern 29 is surrounded (and defined) by a belt surface area, by which a position of correction-use pattern 29 can be determined.

As illustrated in FIG. 10(*c*), the regular reflection receiving unit 27 may output an output signal 35 for the correction-use patterns 29K_Y and 29C_Y. The output signal 35 can be generated by superimposing the diffuse-reflected light component 36 and regular-reflected light component 37. In such configuration, a diffuse reflected light component may not be included in the reflected light, by which only the regular reflected light component may be detected, and thereby a detection error may not occur.

As illustrated in FIG. 10(*c*), the reflected light intensity from a surface of the sheet transport belt 5 may be used as below. A difference between the reflected light intensity obtained from a surface of sheet transport belt 5 and the reflected light intensity obtained by using the correction-use pattern 29 may be computed as a peak value. Based on the peak value, a one-half (½) of the peak value may be set as the thresh line 40, for example. As such, the thresh line 40 may be set at one-half (½) of the peak value. If the thresh line 40 is set as such, a center of width of the correction-use patterns 29K_Y and 29C_Y can be detected with higher precision compared to a case that an irradiation light having a wavelength that has no complementary color relation is used. Accordingly, the correction-use patterns 29 can be detected with a higher S/N ratio compared to an example case illustrated in FIG. 6.

Further, the smallest portion of the pattern width 33 of the correction-use pattern 29K_Y, 29C_Y in sub-scanning direction may be set substantially equal to the spot diameter 31 of the regular reflection receiving unit 27 such as for example 0.6 mm. Further, the smallest portion of the pattern width 33 of the correction-use pattern 29K_S, 29C_S may be also set substantially equal to the spot diameter 31 of the regular reflection receiving unit 27 such as for example 0.6 mm.

In such configuration, an irradiation light may not be irradiated onto adjacently disposed two patterns at the same time, and diffusion light may not be reflected from the adjacently disposed two patterns at the same time.

Accordingly, if the interval 34 of adjacent straight-line patterns of the correction-use pattern 29K_Y, 29C_Y is set to a given value such as the spot diameter 30 or greater, adjacently disposed two patterns may not be detected at the same time, by which the correction-use pattern 29 can be detected reliably.

Accordingly, in FIGS. 9 and 10, the interval 34 of the correction-use pattern 29 may be set to a given value such as 0.6 mm or more. The smallest portion of the interval of adjacent correction-use patterns 29K_S, 29C_S (i.e., slanted line) may be also set substantially equal to a given value such as 0.6 mm or more.

With such a configuration, even for the correction-use patterns 29K_S and 29C_S, diffusion light may not be reflected from two adjacent slanted-line patterns at the same time.

The CPU 49 may compute image positions of the correction-use pattern 29K_Y, 29C_Y used as straight-line pattern, and image positions of the correction-use pattern 29K_S, 29C_S used as slanted-line pattern. Based on such image position computation, the CPU 49 can compute registration deviation in main scanning direction. When correction of image misalignment is conducted using the correction-use patterns 29_KC for black and cyan, registration deviation in a main scanning direction may be computed but other types of deviation may not be computed.

Further, the such computed correction amount may be applied when the high quality printing mode or the thick paper printing mode used under a one-half (½) printing speed is selected, but may not be applied for other printing modes such as normal printing mode.

The image forming apparatus 100 illustrated in FIG. 1 may include a configuration illustrated in FIG. 2, for example. In such configuration, black K image used as reference color and the black K image is formed using one face of the polygon mirror 22, and two colors, such as cyan C and yellow Y image, may be formed using an opposed face of the polygon mirror 22 with respect to black K.

When a red-LED is used to detect the correction-use pattern 29 for cyan C, correction of image misalignment of cyan C with respect to black K can be conducted with higher precision; on one hand, when a blue-LED is used to detect the correction-use pattern 29 for yellow Y, correction of image misalignment of yellow Y with respect to black K can be conducted with higher precision.

In case of FIG. 9, the correction-use pattern 29C_Y, 29C_S for cyan C may be formed in view of device property of photo diode PD (used as light receiver) of the regular reflection receiving unit 27, and the correction-use pattern 29C_Y, 29C_S is detected by using a red-LED.

As illustrated in FIG. 2, when the correction-use pattern 29 for yellow Y image is formed using an opposed face of polygon mirror 22 with respect to black K image used as reference color, a blue-LED may be preferably used to detect the correction-use pattern 29 for yellow Y.

Typically, the PD of the regular reflection receiving unit 27 reacts to an incoming light with a given sensitivity and outputs a signal based on such sensitivity property. Specifically, the PD of the regular reflection receiving unit 27 may react to a light having a wavelength corresponding to red light region with a higher signal-to-noise (S/N) ratio. Such PD can be used to detect a light having a wavelength corresponding to blue light, but the S/N ratio of PD becomes smaller as the wavelength of light becomes closer to blue light region. In view of such condition, if one of red-LED and blue-LED is to be selected, the red-LED may be selected, for example. With such a configuration, the correction-use pattern 29, formed by typical four colors, can be detected reliably.

Figure 11:
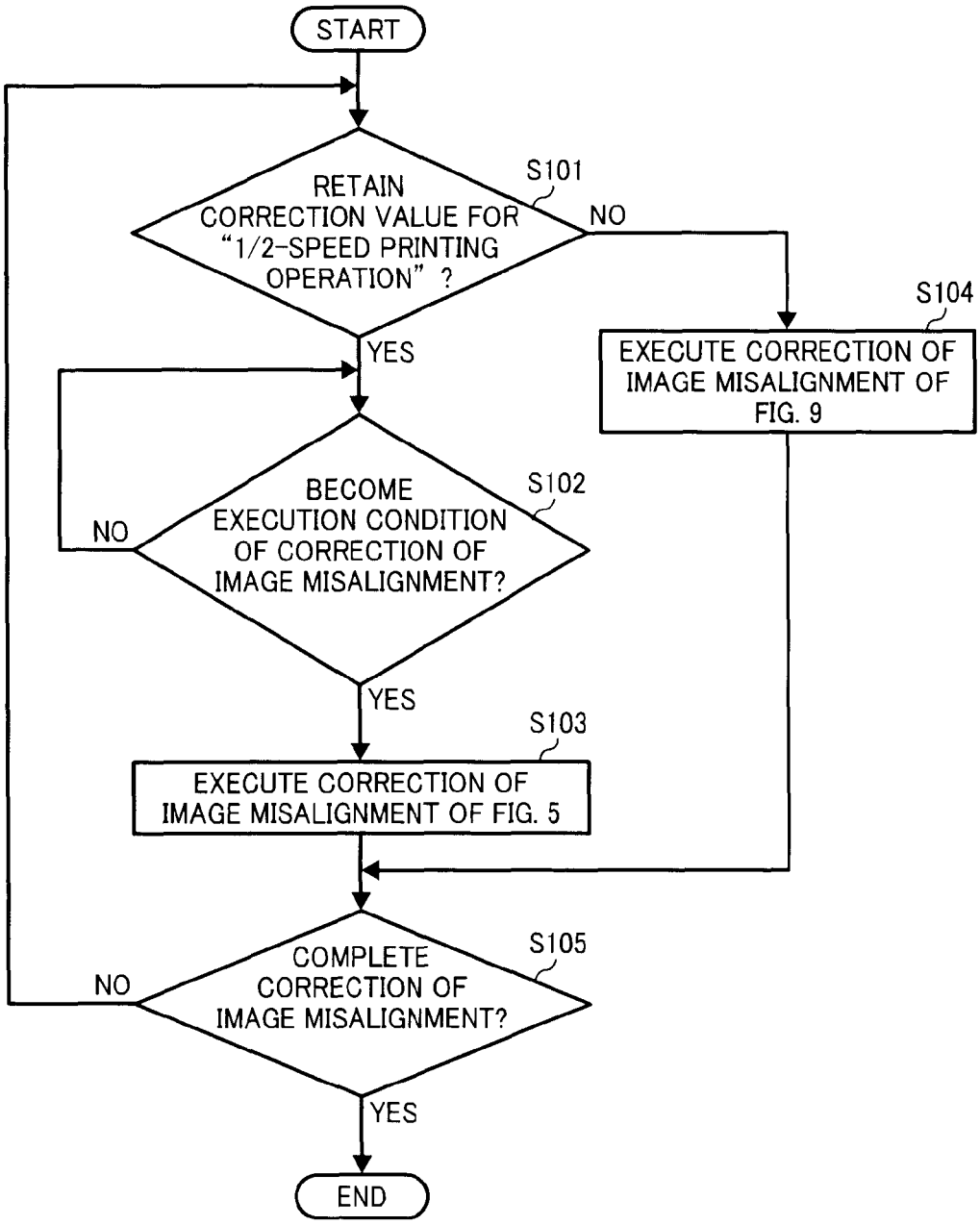
FIG. 11 is a flowchart of control process for correcting image misalignment, in which the correction-use pattern of FIG. 9 is used.

FIG. 11 is a flowchart for processes usable for controlling correction of image misalignment when the correction-use pattern 29 illustrated in FIG. 9 is formed. Such correction of image misalignment may be started when the image forming apparatus is set to "power ON."

At step S101, it is determined whether the RAM 50 of control circuit CONT retains a registration correction amount in main scanning direction set for "½-speed printing operation."

As above described, image misalignment in main scanning direction may be corrected as follows: executing correction of image misalignment by computing correction amount for image misalignment while the rotation number of polygon mirror 22 is changed (to slower speed, for example) in advance; comparing the correction amount for changed speed with correction amount for image misalignment under normal printing mode; storing a difference of correction amount for changed speed with correction amount for image misalignment for normal printing mode.

If it is determined that the RAM 50 retains the registration correction amount in main scanning direction, it is checked whether an execution condition for conducting a correction of image misalignment is satisfied at step S102. The execution condition may include the number of printed sheets after the previous correction of image misalignment, the number of continuously printed sheets, a time duration of continuous printing, or the like, but not limited thereto. The number of printed sheets after the previous correction may be set to 200 sheets, the number of continuously printed sheets may be set to 100 sheets, and the time duration of continuous printing may be set to five minutes, for example.

If it is determined that execution condition is satisfied, or if the execution condition is actually satified, a correction of image misalignment may be conducted using the correction-use pattern 29 formed of four colors illustrated in FIG. 5 at step S103 by interrupting a normal printing operation.

At step S105, it is checked whether the correction of image misalignment is completed. If it is determined that the correction of image misalignment is completed, the process ends. If it is determined that the correction of image misalignment is not completed, the process goes back to step S101, and the above described processes may be repeated.

If the RAM 50 does not retain the correction amount for ½-speed printing operation at step S101, a correction of image misalignment using the correction-use patterns 29_KC for black and cyan illustrated in FIG. 9 is conducted at step S104.

At step S105, it is checked whether the correction of image misalignment is completed. If it is determined that the correction of image misalignment is completed, the process ends. If it is determined that the correction of image misalignment is not completed, the process goes back to step S101, and the above described processes may be repeated.

Figure 12:
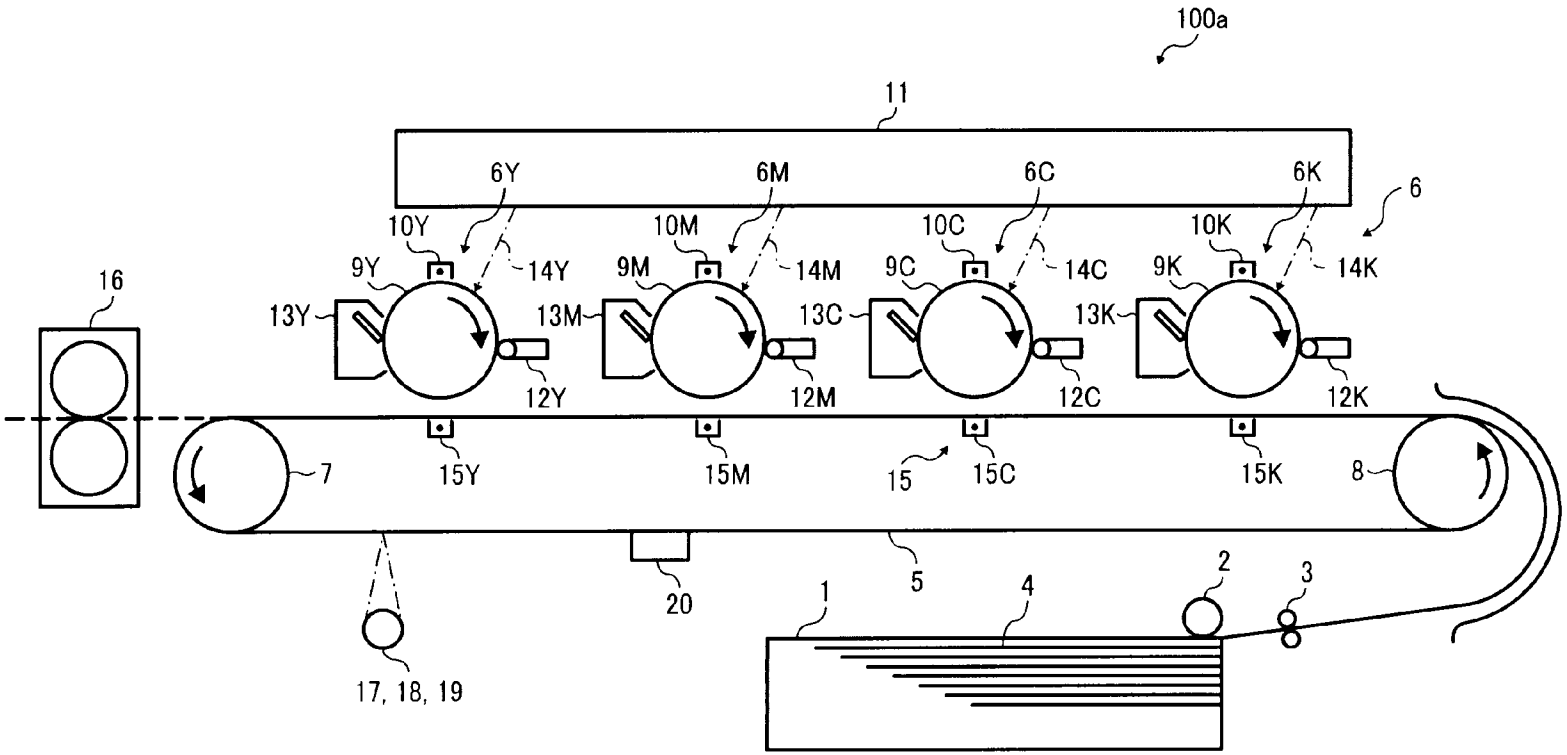
FIG. 12 illustrates a schematic configuration of an image forming apparatus according to a second example embodiment.

FIG. 12 illustrates a schematic configuration of image forming apparatus 100*a* according to an second example embodiment. In second example embodiment, an arrangement order of the image forming units 6K, 6M, 6C, 6Y is changed from the arrangement order set in first example embodiment illustrated in FIG. 1. In first example embodiment, the image forming units 6K, 6M, 6C, 6Y are arranged in this order along a rotation direction of the sheet transport belt 5 from an upstream side of rotation direction. In second example embodiment, the image forming units 6K, 6C, 6M, 6Y are arranged in this order along a rotation direction of the sheet transport belt 5 from an upstream side of rotation direction. As such, the arrangement order of the image forming units for magenta M and cyan C are switched between first example embodiment and second example embodiment. In second example embodiment, such image forming units 6K, 6C, 6M, 6Y may employ a similar internal configuration except colors of formable toner images. As similar to first example embodiment, the image forming unit 6K forms black image, the image forming unit 6C forms cyan image, the image forming unit 6M forms magenta image, and the image forming unit 6Y forms yellow image. Same or similar references may be used for components used in example embodiments in a similar manner.

Figure 13:
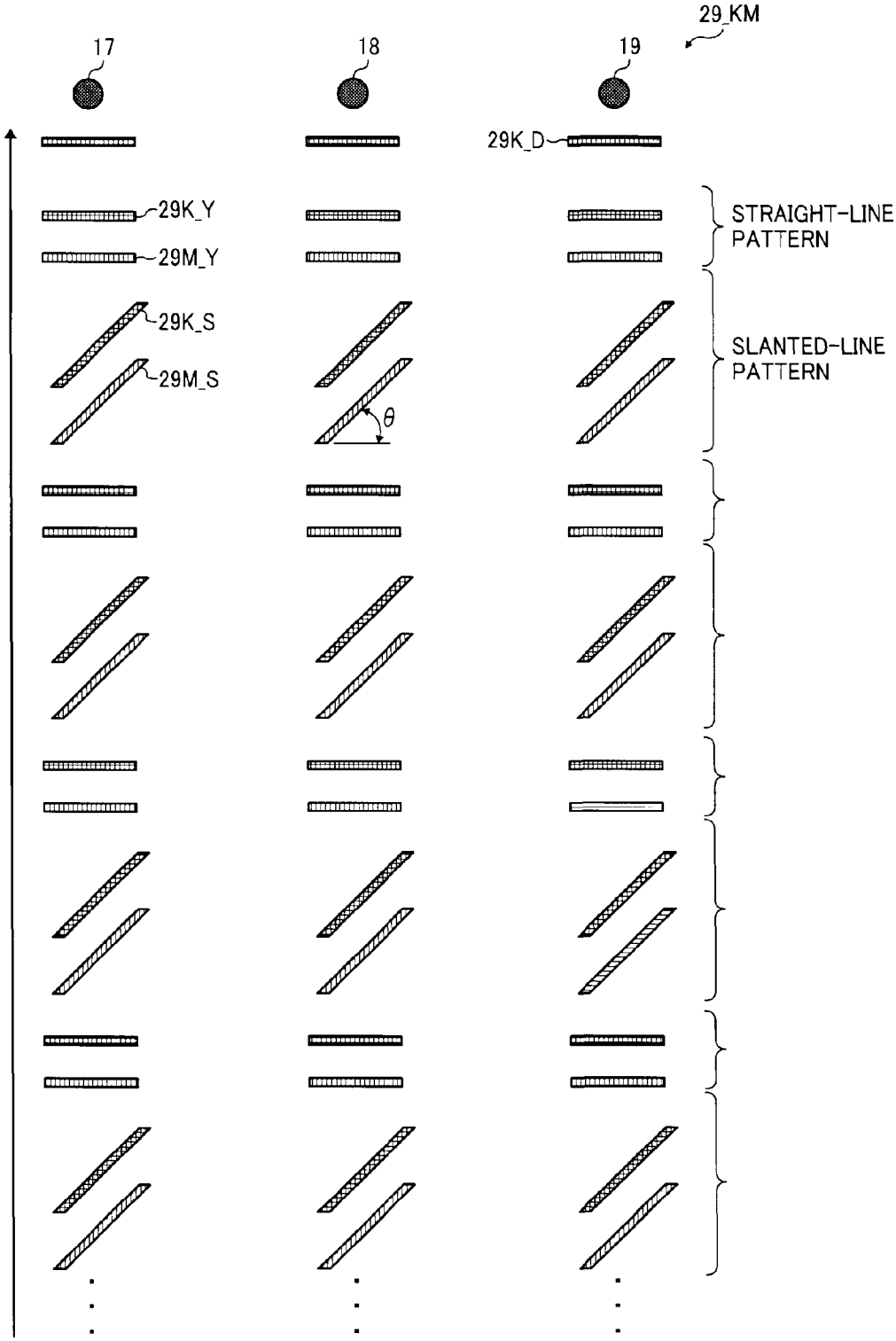
FIG. 13 illustrates example correction-use patterns for the second example embodiment.

FIG. 13 illustrates one example correction-use pattern 29_KM for black and magenta used in second example embodiment. In FIG. 13, the correction-use pattern 29 for magenta M is used instead of the correction-use pattern 29 for cyan C illustrated in FIG. 9. Accordingly, the correction-use pattern 29_KM may include the straight-line patterns 29K_Y, 29M_Y, and the slanted-line patterns 29K_S, 29M_S for black K and magenta M (i.e., two colors), in which one-set pattern includes four line patterns. The slanted-line patterns (_S) may be inclined from left to right at an inclination angle θ=45° in sub-scanning direction, for example. Such patterns are prepared with a plurality of sets in sub-scanning direction, and detected by the TM sensors 17, 18, 19. Further, the correction-use pattern 29_KM may include detection-timing-adjustment pattern 29K_D at the leading head of patterns.

As similar to first example embodiment, when the correction-use patterns 29_KM are formed for black K and magenta M, and the correction-use patterns 29 are detected, the rotation number of the polygon mirror 22, the drive roller 7, and the photoconductor drum 9 may be set to one-half (½) of the normal printing speed under the normal printing mode.

In second example embodiment, the image forming apparatus 100*a* of FIG. 12 may include a configuration illustrated in FIG. 2, for example. In such configuration, a black K image used as reference color and image may be formed using one face of the polygon mirror 22, and two colors such as magenta M and yellow Y images may be formed using an opposed face of the polygon mirror 22 with respect to black K.

When a green-LED is used to detect the correction-use pattern 29 for magenta M, correction of image misalignment of magenta M with respect to black K can be conducted with higher precision; on one hand, when a blue-LED is used to detect the correction-use pattern 29 for yellow Y, correction of image misalignment of yellow Y with respect to black K can be conducted with higher precision.

The photodiode (PD) of the regular reflection receiving unit 27 reacts to an incoming light with a given sensitivity and outputs a signal based on such sensitivity property. Specifically, the PD of the regular reflection receiving unit 27 may react to a light having a longer wavelength in visible light range with a higher signal-to-noise (S/N) ratio. In view of such condition, if one of green-LED and blue-LED is to be selected, the green-LED may be selected. With such a configuration, the correction-use pattern 29, formed by typical four colors, can be detected more reliably compared to the blue-LED.

In second example embodiment, a principle of detection of correction-use pattern is similar to principle of detection of first example embodiment explained with FIG. 10 except some elements. In second example embodiment, instead of the correction-use pattern 29C_Y for cyan C, the correction-use pattern 29M_Y for magenta M is formed, and TM sensors 17, 18, 19 may include the light generation unit 26 having a light source such as LED, which emits a light beam of green light having a wavelength of 520 nm. In such configuration, the diffuse-reflected light component 36 may not reflect from the correction-use pattern 29K_Y for black K and the correction-use pattern 29M_Y for magenta M whereas the regular-reflected light component 37 may not reflect from the correction-use pattern 29. As such, a regular reflected light can be reflected from the sheet transport belt 5 continuously but may not reflect from the correction-use pattern 29. Accordingly, when the correction-use pattern 29 comes under a detection area of the regular reflection receiving unit 27, a regular reflected light may not be reflected from the correction-use pattern 29, but a position of the correction-use pattern 29 can be detected because the correction-use pattern 29 is surrounded (and defined) by a belt surface area, by which a position of correction-use pattern 29 can be determined.

In such configuration, a diffuse reflected light component may not be included in the reflected light reflected from the correction-use pattern 29K_Y and 29M_Y, by which only the regular reflected light component may be detected, and thereby a detection error may not occur, and the correction-use pattern 29 can be detected with a higher S/N ratio as similar to first example embodiment.

In second example embodiment, a control process for correcting image misalignment is conductable as similar to a flowchart for first example embodiment illustrated in FIG. 11 except using the correction-use pattern 29_KM (see FIG. 13) at step S104.

As similar to first example embodiment, in second example embodiment, black K is used as reference color, and the correction-use pattern 29 for magenta M is formed using an opposed face of the polygon motor 22 with respect to black K. Further, a green-LED, which emits a light beam having a wavelength for green light may be used to detect the correction-use pattern 29, in which the green light has a complementary color relation with the correction-use pattern 29 for magenta M. With such a configuration, an effect similar to first example embodiment can be devised.

Figure 14:
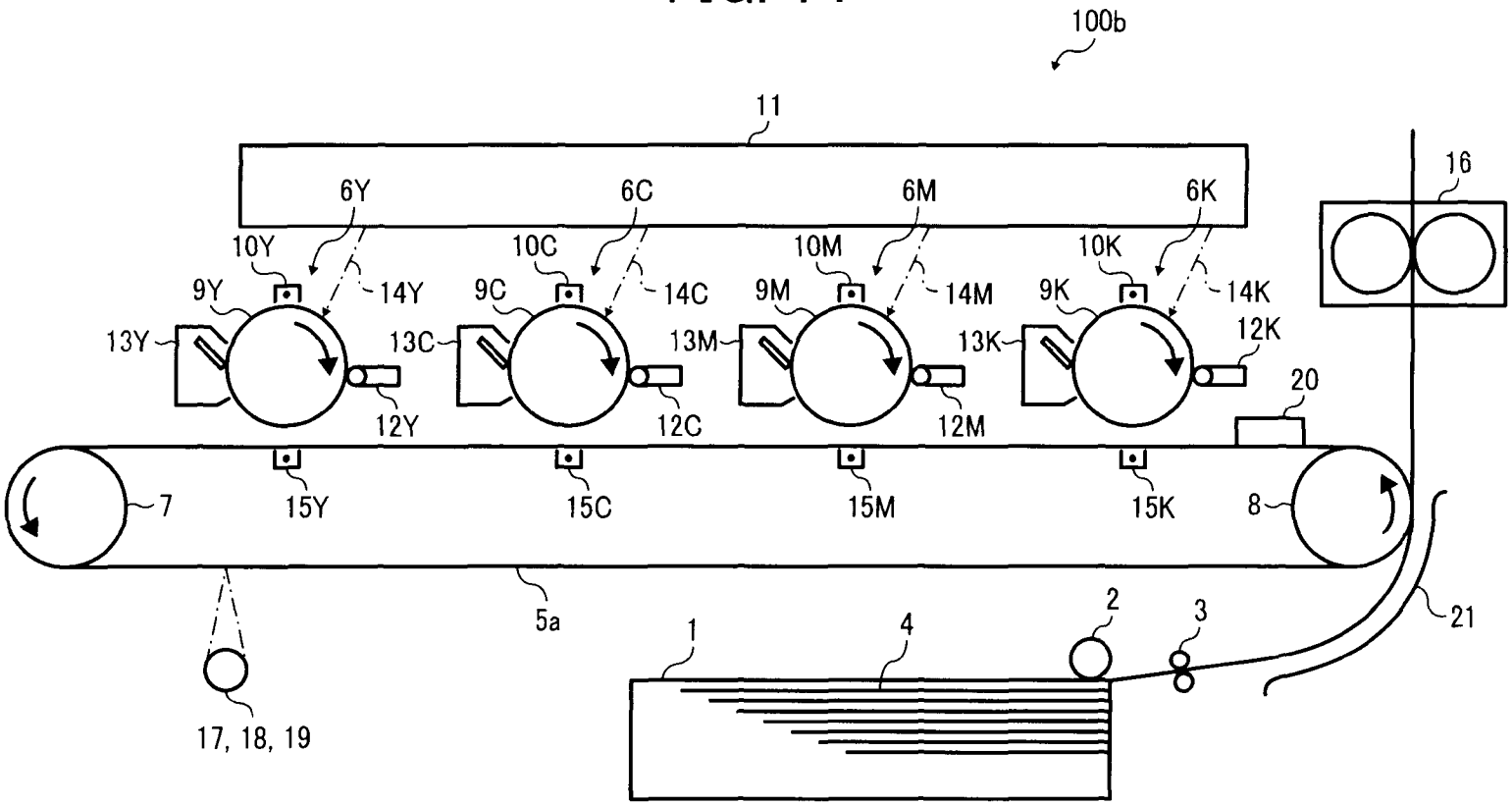
FIG. 14 illustrates a schematic configuration of an image forming apparatus according to a third example embodiment.

FIG. 14 illustrates a schematic configuration of an image forming apparatus 100*b* according to third example embodiment. In third example embodiment, the image forming apparatus 100*b* may be a tandem-type image forming apparatus using an indirect transfer system. In first example embodiment, a sheet transport belt is used for a direct transfer system. Instead of direct transfer system, an intermediate transfer belt may be used in third example embodiment, in which four color images are initially transferred on the intermediate transfer belt as superimposed color image, and then secondary transferred on a sheet to form a full-color image on sheet at one time.

In first example embodiment, the sheet transport belt 5 is used to transport a sheet as illustrated in FIG. 1. In third example embodiment, an intermediate transfer belt 5*a* is disposed as an endless belt and extended by the driven roller 8. A secondary transfer roller may be disposed at a secondary transfer position 21 near the driven roller 8. The sheet 4 is fed to such secondary transfer position 21 to transfer an image from the intermediate transfer belt 5*a* to the sheet 4. The cleaning unit 20 may be disposed at a downstream side of transport direction of the intermediate transfer belt 5*a* with respect to the secondary transfer position 21.

In such configured tandem-type image forming apparatus using the indirect transfer system, when an image forming operation is conducted, toner images of each color formed on the photoconductor drums 9K, 9M, 9C, 9Y are transferred and superimposed to the intermediate transfer belt 5*a* with an effect of the transfer devices 15K, 15M, 15C, 15Y at a primary transfer position where the photoconductor drums 9K, 9M, 9C, 9Y contact the intermediate transfer belt 5*a*. With such process, a full-color image is formed on the intermediate transfer belt 5*a*.

The sheet 4 stored in the sheet feed unit 1 is fed to the secondary transfer position 21, and then a transfer bias voltage is applied at the secondary transfer position 21 to transfer a full-color toner image from the intermediate transfer belt 5*a* to the sheet 4.

Other units may function as similar to units used in the tandem-type image forming apparatus employing the direct transfer system illustrated in first example embodiment. In third example embodiment, correction of image misalignment can be executed using the correction-use pattern 29 illustrated in FIG. 9 or FIG. 11, for example. With such a configuration, an effect similar to first example embodiment can be devised.

Further, as similar to second example embodiment, positions of the image forming units 6M and 6C for magenta M and cyan C can be switched in third example embodiment, in which correction of image misalignment can be executed using the correction-use pattern 29_KM for black K and magenta M.

As such, an image forming apparatus employing a tandem-type or indirect transfer system can be used in a similar manner. For example, as explained in second example embodiment, the correction-use pattern 29_KM may be formed and detected using a LED, which emits a light beam of green light having a wavelength of 520 nm.

Figure 15:
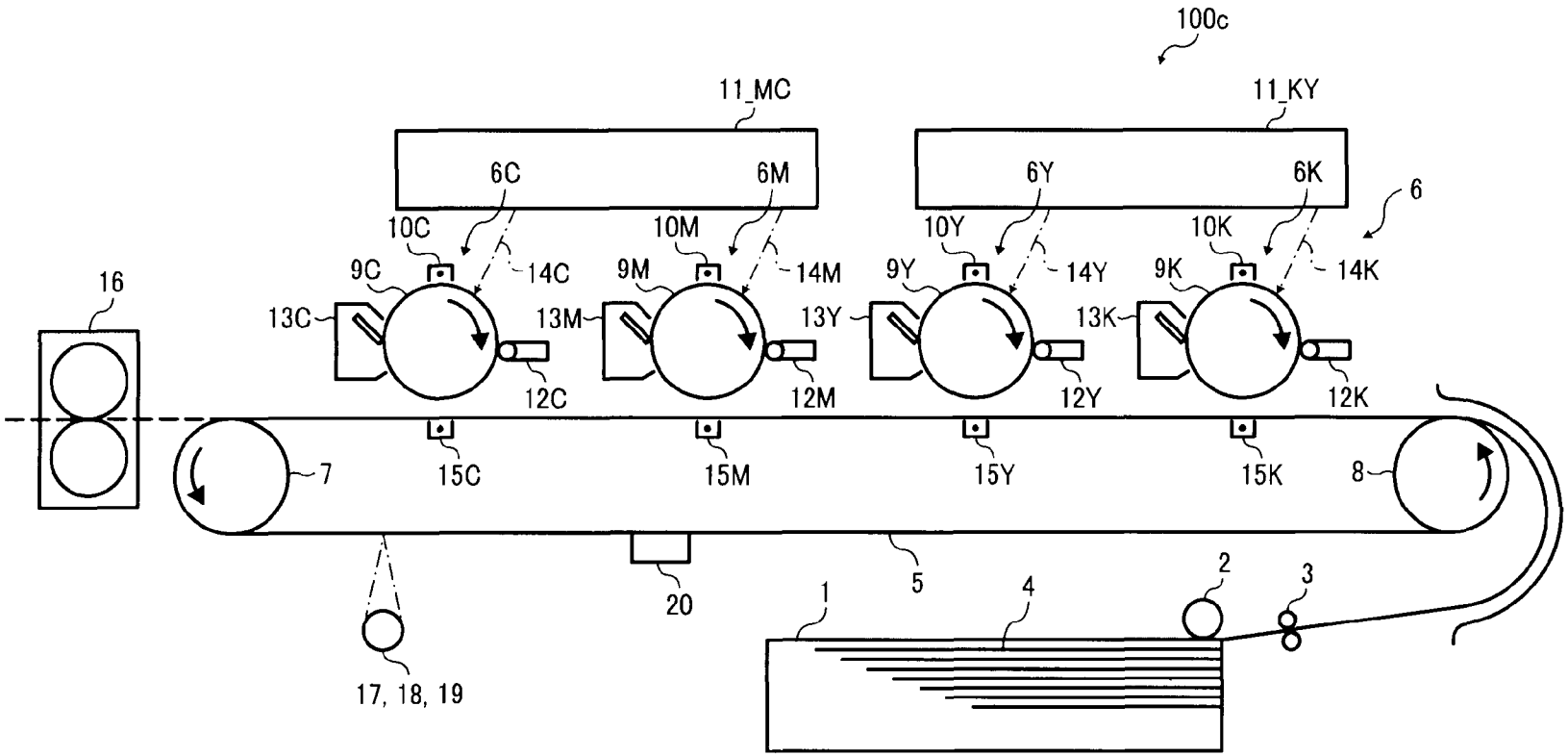
FIG. 15 illustrates a schematic configuration of an image forming apparatus according to a fourth example embodiment.

FIG. 15 illustrates a schematic configuration of an image forming apparatus 100*c* according to fourth example embodiment. In fourth example embodiment, the image forming apparatus 100*c* may change a configuration of the image forming unit 6 and the exposure unit 11 compared to first example embodiment.

As illustrated in FIG. 15, in the image forming apparatus 100*c*, a plurality of image forming units 6K, 6Y, 6M, 6C are arranged along the sheet transport belt 5 from the upstream side of transport direction of the sheet transport belt 5. Such image forming unit 6K, 6Y, 6M, 6C may employ a similar internal configuration except colors of formable toner images. The image forming unit 6K forms black K image, the image forming unit 6Y forms yellow Y image, the image forming unit 6M forms magenta M image, and the image forming unit 6C forms cyan C image.

In fourth example embodiment, the exposure unit 11 may include two exposure units such as a first exposure unit 11_KY and a second exposure unit 11_MC. The first exposure unit 11_KY may irradiate the laser beams 14K and 14Y as exposing light beams to form an image on the image forming units 6K and 6Y, respectively. The second exposure unit 11_MC may irradiate the laser beams 14M and 14C as exposing light beams to form image on the image forming units 6M and 6C, respectively. As such, each of the first exposure unit 11_KY and second exposure unit 11_MC may irradiate two laser beams, whereas the exposure unit 11 illustrated in FIG. 1 irradiates four laser beams. The laser beams 14K, 14Y, 14M, and 14C enter the synchronization detector 25 to adjust a write-start timing.

Figure 16:
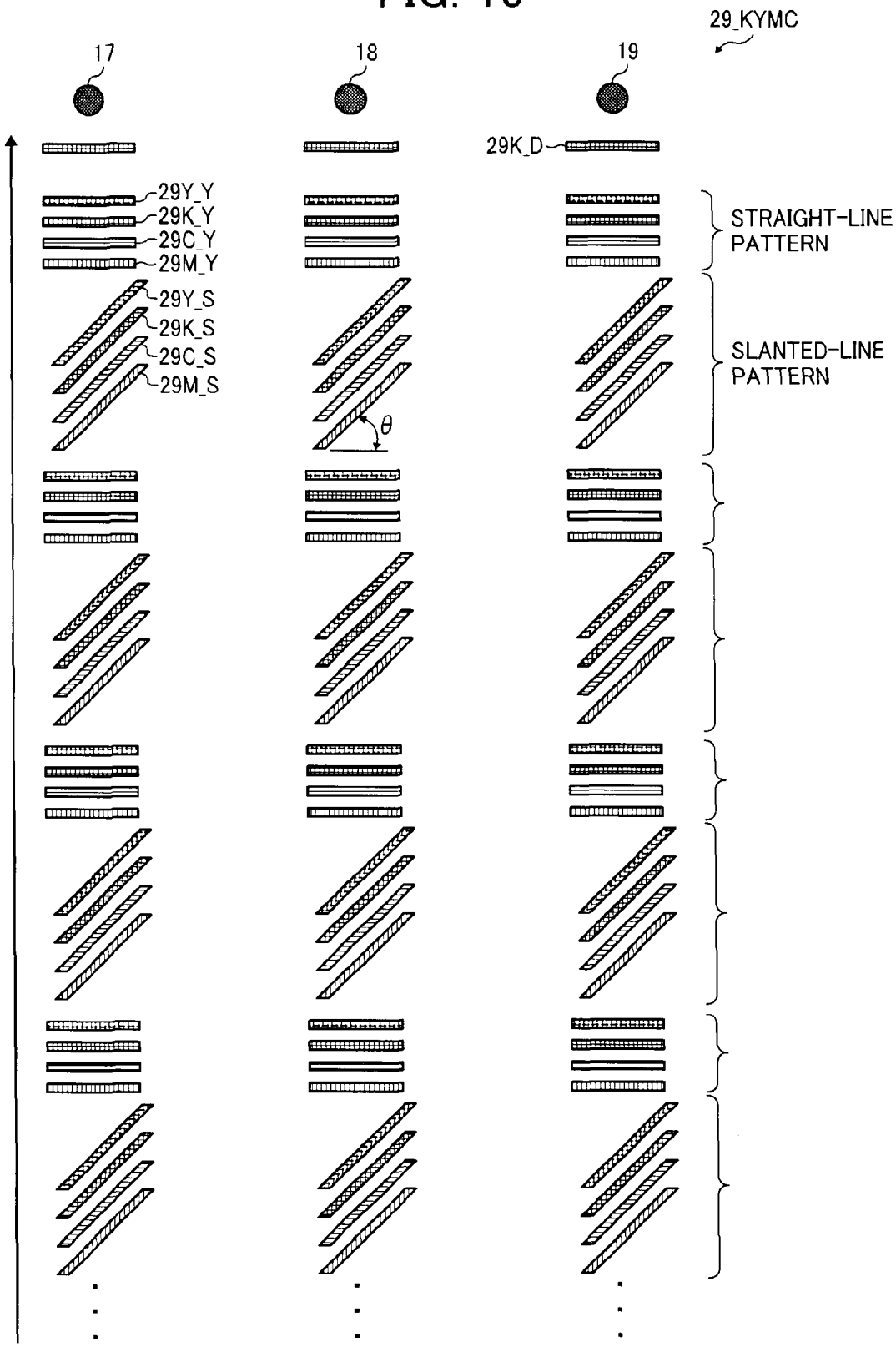
FIG. 16 illustrates an example correction-use pattern for the fourth example embodiment.

FIG. 16 illustrates the correction-use pattern 29_KYMC usable in fourth example embodiment. When the correction-use pattern 29_KYMC are formed and detected, the rotation number of the polygon mirror 22, the drive roller 7, and the photoconductor drum 9 may be set to one-half (½) of the normal printing speed under the normal printing mode. The correction-use pattern 29_KYMC may include the straight-line patterns 29KYMC_Y and the slanted-line patterns 29KYMC_S for KYMC (i.e., four colors), in which one-set pattern includes eight line patterns. The slanted-line patterns may be inclined from left to right at an inclination angle θ=45° in sub-scanning direction, for example. Such patterns may be prepared with a plurality of sets in sub-scanning direction, and detected by the TM sensors 17, 18, 19. Further, the correction-use pattern 29_KYMC may include a detection-timing-adjustment pattern 29K_D at the leading head of patterns.

In fourth example embodiment, the image forming apparatus 100*c* includes the first exposure unit 11_KY and the second exposure unit 11_MC. In the first exposure unit 11_KY, one rotatable multi-faced mirror such as polygon mirror may be used to form a black K image using one face of polygon motor, and to form a yellow Y image using an opposed face of polygon motor with respect to black K used as reference color. Further, in the second exposure unit 11_MC, one rotatable multi-faced mirror such as polygon mirror may be used to form a magenta M image using one face of polygon motor, and to form a cyan C image using an opposed face of polygon mirror with each other.

In such configuration, the CPU 49 computes image positions of straight-line patterns 29K_Y, 29Y_Y and the slanted-line patterns 29K_S, 29Y_S, and image positions of straight-line patterns 29M_Y, 29C_Y and the slanted-line patterns 29M_S, 29C_S as described in first example embodiment. Based on such computed image positions, the CPU 49 computes registration deviation in main scanning direction between black K and yellow Y patterns, and registration deviation in a main scanning direction between magenta M and cyan C patterns. When correction of image misalignment is conducted using the correction-use patterns 29_KYMC, registration deviation in a main scanning direction may be computed but other types of deviation may not be computed.

In fourth example embodiment, a principle of detection of correction-use pattern is similar to principle of detection of first example embodiment explained with FIG. 10 except some elements. In fourth example embodiment, the light generation unit 26 may use a LED, which emits a light beam of blue light having a wavelength of 450 nm. In such configuration, the diffuse-reflected light component 36 may not reflect from the correction-use pattern 29K_Y for black K and the correction-use pattern 29Y_Y for yellow Y whereas the regular-reflected light component 37 may not reflect from the correction-use pattern 29. As such, a regular reflected light can be reflected from the sheet transport belt 5 continuously but may not reflect from the correction-use pattern 29. Accordingly, when the correction-use pattern 29 comes under a detection area of the regular reflection receiving unit 27, a regular reflected light may not be reflected from the correction-use pattern 29, but a position of the correction-use pattern 29 can be detected because the correction-use pattern 29 is surrounded (and defined) by a belt surface area, by which a position of correction-use pattern 29 can be determined.

In such configuration, a diffuse reflected light component may not be included in the reflected light reflected from the correction-use pattern 29K_Y for black K and correction-use pattern 29Y_Y for yellow Y, by which the output signal 35 may not include a diffuse reflected light component for reflected light reflected from the correction-use pattern 29K_Y and correction-use pattern 29Y_Y. With such a configuration, detection error can be prevented as explained in first example embodiment, and the correction-use pattern 29 can be detected with a higher S/N ratio compared to a case using the correction-use pattern 29 of FIG. 6.

In contrast, the diffuse-reflected light component 36 may reflect from the correction-use pattern 29M_Y for magenta M and the correction-use pattern 29C_Y for cyan Y, by which detection error may occur for both of the correction-use pattern 29M_Y and the correction-use pattern 29C_Y. However, because detection error may similarly occur for such two colors (magenta M and cyan Y) between the correction-use pattern 29M and the correction-use pattern 29C (i.e., magenta M and cyan Y), effect of detection error may be cancelled. For example, assume that a pattern M has a coordinate of 100 μm, and a pattern C has a coordinate of 200 μm, in which image misalignment of M and C becomes 100 μm (=200 μm−100 μm), and the detection error by the diffuse reflected light is +10 μm, which is same for magenta M and cyan Y. Accordingly, the TM sensor detects the coordinate of pattern M as 110 μm (=100+10 μm), and the coordinate of pattern C as 210 μm (=200+10 μm), in which image misalignment of M and C becomes 100 μm (=210 μm−110 μm). Accordingly, an effect of detection error can be cancelled.

Accordingly, by using a blue-LED in the light generation unit 26 of the TM sensors 17, 18, 19, correction of image misalignment between the image forming unit 6K and 6Y (black K and yellow Y), and between the image forming unit 6M and 6C (magenta M and cyan C) can be conducted with higher precision.

In fourth example embodiment, a control process for correcting image misalignment is conductable as similar to a flowchart for first example embodiment illustrated in FIG. 11 except using the correction-use pattern 29_KYMC (see FIG. 16) at step S104.

Figure 17:
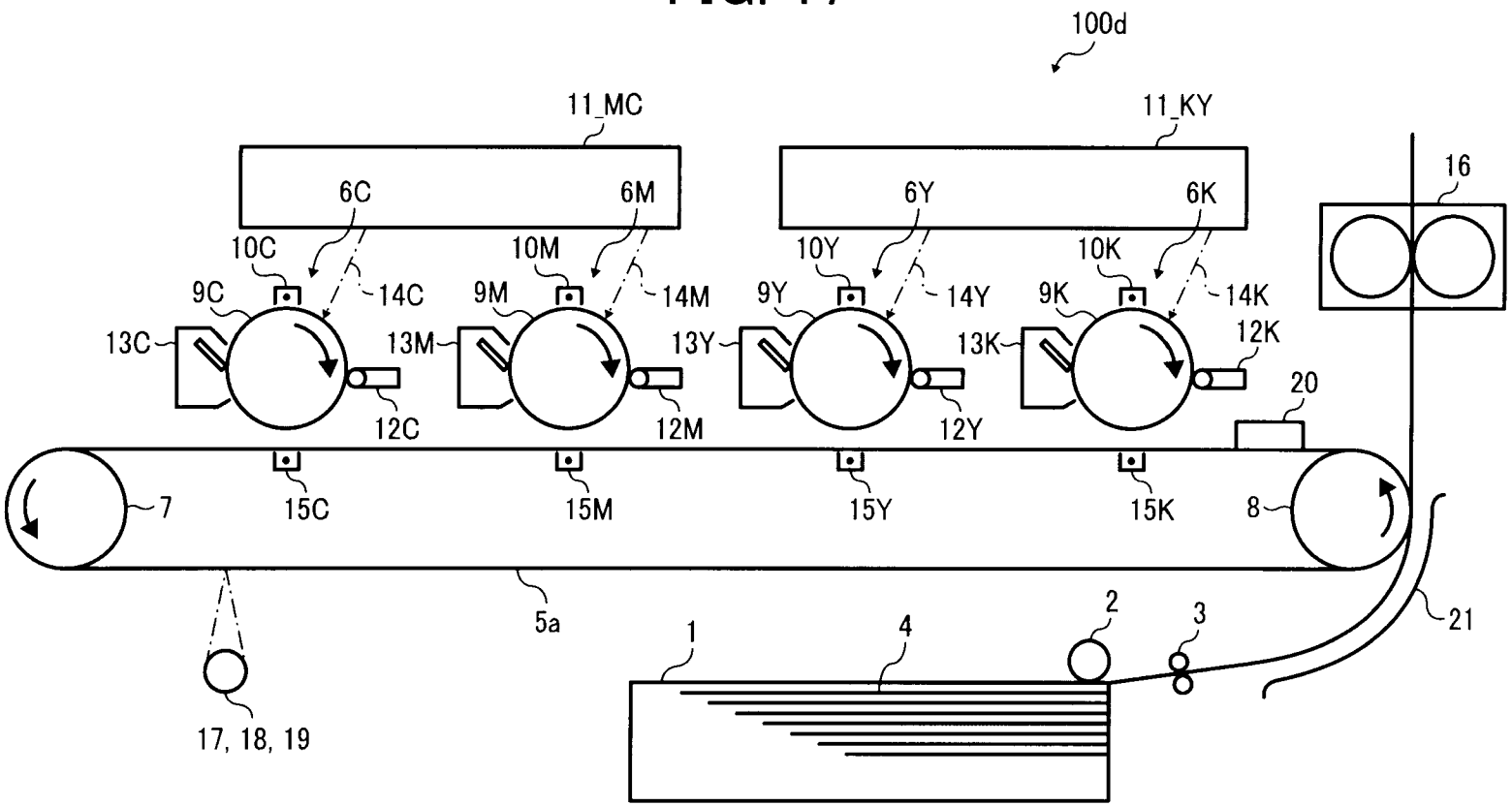
FIG. 17 illustrates a schematic configuration of an image forming apparatus according to a fifth example embodiment.

FIG. 17 illustrates a schematic configuration of an image forming apparatus 100*d* according to fifth example embodiment. In fifth example embodiment, the image forming apparatus 100*d* may be a tandem-type image forming apparatus using an indirect transfer system. In fourth example embodiment, a direct transfer system is used by employing a sheet transport belt. Instead of direct transfer system, an intermediate transfer belt is used in fifth example embodiment, in which image is initially transferred to the intermediate transfer belt as superimposed image, and then secondary transferred onto a sheet to form a full-color image at one time.

In fifth example embodiment, a plurality of image forming units 6K, 6Y, 6M, 6C are arranged along the intermediate transfer belt 5*a* from upstream side of transport direction of the intermediate transfer belt 5*a*. As such, the image forming apparatus 100*d* is used as a tandem-type image forming apparatus using an indirect transfer system, such as color image forming apparatus. In fifth example embodiment, the arrangement order of image forming units 6K, 6Y, 6M, 6C in fourth example embodiment can be employed; a configuration of two exposure units such as first exposure unit 11_KY and second exposure unit 11_MC in fourth example embodiment can be employed; the indirect transfer system such as transferring from the intermediate transfer belt 5*a* to the sheet 4 in third example embodiment can be employed.

In the above described example embodiments, a reference color pattern (or image) and other color pattern (or image) are formed as a developed image. Then, an irradiation light having a given wavelength matched to a spectral sensitivity peak of the other color pattern is irradiated to the reference color pattern and other color pattern to detect reflected light intensity from the reference color pattern and other color pattern. Then, based on based on a light intensity of reflected light reflected from the reference color pattern and a light intensity of reflected light reflected from the first color pattern, detected by the pattern detector, an image misalignment value between two color images of the reference color pattern and the first color pattern is computed. With such a configuration, a detection error caused by diffuse reflected light can be prevented or suppressed, by which a lower cost light detector can be used to detect color patterns reliably, and to conduct correction of image misalignment correctly.

With such a configuration, the correction-use pattern 29 can be formed and detected, and correction of image misalignment can be conducted as similar to fourth example embodiment, and images can be transferred as similar to third example embodiment. Accordingly, in fifth example embodiment, by using a blue-LED in the light generation unit 26 of the TM sensors 17, 18, 19, correction of image misalignment between the image forming units 6K and 6Y (black K and yellow Y), and between the image forming units 6M and 6C (magenta M and cyan C) can be conducted with higher precision.

In the above-described exemplary embodiments, a computer can be used with a computer-readable program to control functional units used for an image forming apparatus. For example, a particular computer may control the image forming apparatus or system using a computer-readable program, which can execute the above-described processes or steps. Further, in the above-described exemplary embodiments, a storage device (or recording medium), which can store computer-readable program, may be a flexible disk, a compact disk read only memory (CD-ROM), a digital versatile disk read only memory (DVD-ROM), DVD recording only/rewritable (DVD-R/RW), a magneto optical disc (MO), a memory card, a memory chip, a mini disk (MD), magnetic tape, hard disk such in a server, or the like, but not limited these. Further, a computer-readable program can be downloaded to a particular computer (e.g., personal computer) via a network, or a computer-readable program can be installed to a particular computer from the above-mentioned storage device, by which the particular computer may be used for the image forming apparatus according to exemplary embodiments, for example.

The above described example embodiments can be applied apparatuses for forming a visible image by superimposing a plurality of color images one to another, and apparatuses for forming a visible image by superimposing a plurality of color images one to another and including a function of correcting image misalignment by correcting image position.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

an endless transport member;

a plurality of image forming units including a plurality of image bearing members arranged along a moving direction of the endless transport member, each of the image bearing members forming images of one of multiple colors using electrophotography, the images transferable to the endless transport member, each of the image forming units useable as a pattern forming unit to form a plurality of correction-use patterns for each color on the endless transport member;

a pattern detector, disposed near the endless transport member, to detect the correction-use patterns formed on the endless transport member by directing a light beam onto the correction-use patterns formed on the endless transport member, the pattern detector capable of detecting regular reflected light and diffuse reflected light reflecting from the endless transport member and the correction-use patterns formed on the endless transport member;

an image misalignment detector to detect image misalignment of the correction-use patterns formed on the endless transport member based on a detection result of the correction-use patterns obtained by the pattern detector; and a rotatable multi-faced mirror to optically scan the image bearing member, wherein the pattern forming unit forms at least a reference color pattern and a first color pattern as correction-use patterns, each of the reference color pattern and the first color pattern being formed as a developed image, the pattern detector uses an irradiation light having a first wavelength matched to a spectral sensitivity peak of the first color pattern to detect an intensity of light reflected from the endless transport member having the reference color pattern and the first color pattern formed thereon, the image misalignment detector computes an image misalignment value between two color images of the reference color pattern and the first color pattern, based on the intensity of reflected light reflected from the reference color pattern and the first color pattern as detected by the pattern detector, and the rotatable multi-faced mirror uses a first reflection face for exposing the reference color pattern and a second reflection face opposing the first reflection face for exposing other color patterns, wherein one of:

the first wavelength corresponds to red light and the first color pattern includes a cyan pattern, the first wavelength corresponds to green light and the first color pattern includes a magenta pattern, and the first wavelength corresponds to blue light and the first color pattern includes a yellow pattern.

2. The image forming apparatus according to claim 1, wherein the pattern forming unit forms the correction-use patterns used for computing the image misalignment value between two color images, and a transport speed of the endless transport member and an optical writing speed onto the image bearing member when forming the correction-use patterns used for computing the image misalignment value between two color images are different from a transport speed of the endless transport member and an optical writing speed onto the image bearing member when computing image misalignment value between all of the colors by forming correction-use patterns of all of the colors used for image forming.

3. The image forming apparatus according to claim 1, wherein the correction-use pattern includes a first orientation pattern and a second orientation pattern extending at angles to a sub-scanning direction, the first orientation pattern extends at an inclination angle θ1 with respect to the sub-scanning direction, the second orientation pattern extends at an inclination angle θ2 different from inclination angle θ1 with respect to the sub-scanning direction, and the first orientation pattern and the second orientation pattern each include a plurality of patterns formed in the sub-scanning direction, in which a combination of different colors is formed as a single set and a plurality of sets repeated throughout the patterns.

4. The image forming apparatus according to claim 1, wherein the other color patterns include the cyan pattern and the second reflection face exposes the cyan pattern, and the first wavelength corresponds to the red light and the first color pattern corresponds to the cyan pattern.

5. The image forming apparatus according to claim 1, wherein the other color patterns include the magenta pattern and the yellow pattern and the second reflection face exposes the magenta pattern and yellow pattern, and the first wavelength corresponds to the green light, and the first color pattern corresponds to the magenta pattern.

6. The image forming apparatus according to claim 1 wherein the the other color patterns include the yellow pattern and the second reflection face exposes the yellow pattern, the first wavelength corresponds to the blue light, and the first color pattern corresponds to the yellow pattern.

7. A method of correcting image misalignment of images formed by an image forming apparatus, the image forming apparatus including:

an endless transport member;

a plurality of image forming units including a plurality of image bearing members arranged along a moving direction of the endless transport member, each of the image bearing members forming images of one of multiple colors using electrophotography, the images transferable to the endless transport member, each of the image forming units useable as a pattern forming unit to form a plurality of correction-use patterns for each color on the endless transport member;

a pattern detector, disposed near the endless transport member, to detect the correction-use patterns formed on the endless transport member by directing a light beam onto the correction-use patterns formed on the endless transport member, the pattern detector capable of detecting regular reflected light and diffuse reflected light reflected from the endless transport member and the correction-use patterns formed on the endless transport member;

an image misalignment detector to detect image misalignment of the correction-use patterns formed on the endless transport member based on a detection result of the correction-use patterns obtained by the pattern detector; and a rotatable multi-faced mirror to optically scan the image bearing member, the method comprising the steps of:

forming at least a reference color pattern and a first color pattern using the pattern forming unit as correction-use patterns, each of the reference color pattern and the first color pattern being formed as a developed image;

detecting, using the pattern detector, an intensity of light reflected from the endless transport member and the correction-use patterns formed on the endless transport member by irradiating the reference color pattern and the first color pattern with an irradiation light having a first wavelength matched to a spectral sensitivity peak of the first color pattern; and computing, using the image misalignment detector, an image misalignment value between two color images of the reference color pattern and the first color pattern, based on the intensity of reflected light reflected from the reference color pattern and the first color pattern as detected by the pattern detector, wherein the rotatable multi-faced mirror uses a first reflection face for exposing the reference color pattern and a second reflection face opposing the first reflection face for exposing other color patterns, wherein one of:

the first wavelength corresponds to red light and the first color pattern includes a cyan pattern, the first wavelength corresponds to green light and the first color pattern includes a magenta pattern, and the first wavelength corresponds to blue light and the first color pattern includes a yellow pattern.

8. The method according to claim 7, wherein the forming step forms the correction-use patterns used for computing the image misalignment value between two color images of the reference color pattern and the first color pattern, and a transport speed of the endless transport member and an optical writing speed onto the image bearing member when forming the correction-use patterns used for computing the image misalignment value between two color images are differ from a transport speed of the endless transport member and an optical writing speed onto the image bearing member when computing image misalignment value between all of the colors by forming correction-use patterns of all of the colors used for image forming.

9. The method according to claim 7, wherein the correction-use pattern includes a first orientation pattern and a second orientation pattern extending at a given inclination angle to a sub-scanning direction, the first orientation pattern extends at an inclination angle θ1 with respect to the sub-scanning direction, the second orientation pattern extends at an inclination angle θ2 different from the inclination angle θ1 with respect to the sub-scanning direction, the first orientation pattern and the second orientation pattern include a plurality of patterns formed in the sub-scanning direction, in which a combination of different colors is formed as a single set and a plurality of sets repeated throughout the patterns.

10. The method according to claim 7, wherein the other color patterns include a cyan pattern and the second reflection face exposes the cyan pattern, and the first wavelength corresponds to red light and the first color pattern corresponds to the cyan pattern.

11. The method according to claim 7, wherein the other color patterns include a magenta pattern and a yellow pattern and the second reflection face exposes the magenta pattern and the yellow pattern, and the first wavelength corresponds to green light and the first color pattern corresponds to the magenta pattern.

12. The method according to claim 7, wherein the other color patterns include a yellow pattern and the second reflection face exposes the yellow pattern, the first wavelength corresponds to blue light and the first color pattern corresponds to the yellow pattern.

13. A non-transitory computer-readable medium storing a program for correcting image misalignment of images formed by an image forming apparatus, the program comprising instructions that when executed by a computer cause the computer to execute a method of correcting image misalignment of images formed by an image forming apparatus, the image forming apparatus including an endless transport member;

a plurality of image forming units including a plurality of image bearing members arranged along a moving direction of the endless transport member, each of the image bearing members forming images of one of multiple colors using electrophotography, the images transferable to the endless transport member, each of the image forming units useable as a pattern forming unit to form a plurality of correction-use patterns for each color on the endless transport member;

a pattern detector, disposed near the endless transport member, to detect the correction-use patterns formed on the endless transport member by directing a light beam onto the correction-use patterns formed on the endless transport member, the pattern detector capable of detecting regular reflected light and diffuse reflected light reflected from the endless transport member and the correction-use patterns formed on the endless transport member;

an image misalignment detector to detect image misalignment of the correction-use patterns formed on the endless transport member based on a detection result of the correction-use patterns obtained by the pattern detector; and a rotatable multi-faced mirror to optically scan the image bearing member, the method comprising the steps of:

forming at least a reference color pattern and a first color pattern using the pattern forming unit as correction-use patterns, each of the reference color pattern and the first color pattern being formed as a developed image;

detecting, using the pattern detector, an intensity of light reflected from the endless transport member and the correction-use patterns formed on the endless transport member by irradiating the reference color pattern and the first color pattern with an irradiation light having a first wavelength matched to a spectral sensitivity peak of the first color pattern; and computing, using the image misalignment detector, an image misalignment value between two color images of the reference color pattern and the first color pattern, based on the intensity of reflected light reflected from the reference color pattern and the first color pattern as detected by the pattern detector, wherein the rotatable multi-faced mirror uses a first reflection face for exposing the reference color pattern and a second reflection face opposing the first reflection face for exposing other color patterns, wherein one of:

the first wavelength corresponds to red light and the first color pattern includes a cyan pattern, the first wavelength corresponds to green light and the first color pattern includes a magenta pattern, and the first wavelength corresponds to blue light and the first color pattern includes a yellow pattern.

* * * * *